US006094559A

United States Patent [19]

Otsuka et al.

[11] Patent Number: 6,094,559

[45] Date of Patent: Jul. 25, 2000

[54] FIXING APPARATUS HAVING CLEANING MODE AND STORAGE MEDIUM STORING PROGRAM THEREFOR

[75] Inventors: Yasumasa Otsuka, Yokohama; Koichi Okuda, Tokyo; Akira Hayakawa, Abiko; Tetsuo Kishida, Toride; Masahito Omata, Toride; Akira Kato, Toride; Kazuo Suzuki; Tsuyoshi Yokota, both of Chichibu, all of Japan

[73] Assignee: Canon Kabushiki Kaisha, Tokyo, Japan

[21] Appl. No.: 09/113,352

[22] Filed: Jul. 10, 1998

[30] Foreign Application Priority Data

| | | | |
|---|---|---|---|
| Jul. 14, 1997 | [JP] | Japan | 9-188818 |
| Jul. 31, 1997 | [JP] | Japan | 9-219834 |
| May 29, 1998 | [JP] | Japan | 10-165969 |
| Jul. 9, 1998 | [JP] | Japan | 10-194690 |

[51] Int. Cl.[7] ..... G03G 15/20; G03G 15/00

[52] U.S. Cl. ..... 399/327; 399/68; 399/69

[58] Field of Search ..... 399/68, 322, 327, 399/333, 98, 99, 69, 43; 15/256.5, 256.51, 256.52, 256.53; 219/216

[56] References Cited

U.S. PATENT DOCUMENTS

| | | | |
|---|---|---|---|
| 5,138,390 | 8/1992 | Miyabayashi et al. | 399/327 X |
| 5,142,340 | 8/1992 | Farrell et al. | 399/327 |
| 5,253,024 | 10/1993 | Okuda et al. | 399/324 |
| 5,420,679 | 5/1995 | Goto et al. | 399/335 |
| 5,444,521 | 8/1995 | Tomoyuki et al. | 399/69 |
| 5,592,276 | 1/1997 | Ohtsuka et al. | 399/335 |
| 5,649,273 | 7/1997 | Shimizu et al. | 399/333 X |
| 5,679,462 | 10/1997 | Soga et al. | 399/333 X |
| 5,697,037 | 12/1997 | Yano et al. | 399/333 |
| 5,865,121 | 2/1999 | Testardi et al. | 399/327 X |

FOREIGN PATENT DOCUMENTS

| | | |
|---|---|---|
| 2-160276 | 6/1990 | Japan . |
| 3-58074 | 3/1991 | Japan . |
| 3-117962 | 5/1991 | Japan . |
| 3-240086 | 10/1991 | Japan . |
| 5-158375 | 6/1993 | Japan . |
| 7-064432 | 3/1995 | Japan . |
| 7-104604 | 4/1995 | Japan . |

*Primary Examiner*—Sandra Brase
*Assistant Examiner*—Sophia S. Chen
*Attorney, Agent, or Firm*—Fitzpatrick, Cella. Harper & Scinto

[57] ABSTRACT

The present invention provides a fixing apparatus with a pair of fixing members at least one of which is rotatable, a nip being formed between the fixing members and a recording material which carries a non-fixed toner being conveyed through the nip and heated at the nip to fix the non-fixed toner onto the recording material. The apparatus has a cleaning mode for cleaning the fixing member, in which a sheet is pinched by the nip, and the sheet is conveyed in a direction by repeating rotation and stoppage of the rotatable fixing member.

69 Claims, 15 Drawing Sheets

S91
START SWITCH MODE
S92
CLEANING MODE ?
NO
TO ANOTHER TREATMENTS
YES
S93
START MOTOR ROTATION ON HEATER
S94
HEATER TEMP. T≧PRESSURE ROLLER SURFACE TEMP. T1' ?
NO
YES
S95
START SHEET-SUPPLY
S96
SHEET TIP END GONE OUT NIP ?
NO
YES
S97
SET HEATER TEMP. T EQUAL TO T2'
S98
SHEET TRAIL END ENTERED INTO NIP ?
NO
YES
S99
OFF HEATER
S100
SHEET-DISCHARGE FINISHIED ?
NO
YES
S101
STOP MOTOR
S102
END

FIXING APPARATUS HAVING CLEANING MODE AND STORAGE MEDIUM STORING PROGRAM THEREFOR

BACKGROUND OF THE INVENTION

1. Field of the Invention

The present invention relates to a fixing apparatus used with an image forming apparatus such as an electrophotographic copying machine, an electrophotographic laser beam printer and the like, and a storage medium for storing a program for carrying out a cleaning process of the fixing apparatus which can be read by a computer.

2. Related Background Art

In the past, as fixing apparatus used with an image forming apparatus such as an electrophotographic copying machine, an electrophotographic laser beam printer and the like, a fixing apparatus of heat roller type and a fixing apparatus of on demand type have been proposed. In the fixing apparatus of heat roller type, a pair of roller (fixing roller and a pressure roller) having a heating device are urged against each other to form a nip therebetween and, by passing a sheet as a recording material (such as a paper sheet) through the nip, the toner on the sheet is fused, thereby fixing the toner to the sheet.

Among the pair of rollers, the fixing roller contacted with the front surface of the sheet (bearing the toner) is a cylindrical roller having a surface made of material having good mold releasing ability and has a halogen heater (heating device) therein for heating the toner. On the other hand, the pressure roller contacted with a rear surface of the sheet is constituted by a core cylinder and an elastic layer coated on the core cylinder and serves to pressurize the toner layer appropriately.

Although it is ideal that all the toner on the front surface of the sheet is thermally fused to be fixed to the front surface of the sheet, if there are cold offset toner which was not completely fused, hot offset toner which was fused excessively or/and toner which was offset to the fixing roller electrostatically (referred to as "toner contamination" herein after), such toner contamination is adhered to the surface of the roller (fixing roller or pressure roller) which has lower mold releasing ability.

When the fixing roller has lower mold releasing ability than that of the pressure roller, the toner contamination is adhered to the fixing roller. In this case, since the fixing roller is always heated to the toner fusing temperature during image formation, the toner contamination is in a fused condition. Thus, since the toner contamination is shifted to a next sheet by mixing with a toner image on the next sheet, it is hard that the fixing roller is continuously contaminated. However, rarely, the toner contamination remains on the surface of the fixing roller. In such a case, the image on the sheet may be contaminated.

On the other hand, when the pressure roller has lower mold releasing ability than that of the fixing roller, the toner contamination which was offset to the fixing roller once is transferred to the pressure roller. Since the temperature of the pressure roller is lower than that of the fixing roller, the transferred toner contamination is not always completely fused on the pressure roller. Further, the pressure roller is not contacted with the toner image on the front surface of the sheet, the toner contamination is not entrained by the toner image, with the result that the toner contamination is accumulated on the pressure roller. If the toner contamination is accumulated on the pressure roller greatly, since the mold releasing ability of the pressure roller is decreased, the sheet will be adhered to the pressure roller or the accumulated toner contamination will be transferred to the rear surface of the sheet at once, thereby contaminating the sheet.

In the fixing apparatus of on demand type, in place of the halogen heater and the fixing roller of the fixing apparatus of heat roller type, a heater such as a ceramic heater and a thin film made of polyimide are used to reduce heat capacity of the fixing apparatus, thereby permitting quick start and saving energy or power.

In such a fixing apparatus of on demand type, since the heat capacity is small and temperature response is excellent, it is not required to preheat the fixing apparatus and fine temperature control can be effected, and the energization of the fixing apparatus can be turned OFF when the sheet is not passed.

However, in the fixing apparatus of on demand type, if the above-mentioned temperature control is effected, since the pressure roller is not heated when the sheet is not passed, the temperature is hard to be increased in comparison with the fixing apparatus of heat roller type (about 100° C. at the maximum). Thus, the toner contamination offset to the fixing roller and transferred to the pressure roller is not fused on the pressure roller and remains on the pressure roller in a cured condition.

Since such a condition is existed, even when the cleaning is effected by using a cleaning paper disclosed in Japanese Patent Application Laid-Open No. 3-58074 (1991) (i.e., a sheet on which a solid image was fixed), the cured toner on the pressure roller cannot be cleaned. On the contrary, in some cases, the solid image on the cleaning paper may be stripped by the cured toner on the pressure roller to promote the toner contamination on the pressure roller.

Incidentally, in both of the fixing apparatus of heat roller type and the fixing apparatus of on demand type, when the cleaning is effected by using the cleaning paper, it is required that the cleaning paper on which the solid image was previously formed is supplied in a manner reverse to the normal sheet pass (i.e., a manner in which the solid image is to be contacted with the pressure roller). Thus, the cleaning operation is troublesome or erroneous cleaning operation may occur.

SUMMARY OF THE INVENTION

An object of the present invention is to provide a fixing device in which toner contamination can be removed effectively without using a cleaning paper to eliminate problems caused by using the cleaning paper.

Another object of the present invention is to provide a fixing apparatus comprising a pair of fixing members at least one of which is rotatable wherein a nip is formed between the fixing members and a recording material which carries a non-fixed toner is conveyed through the nip and heated at the nip to fix the non-fixed toner onto the recording material. Wherein said apparatus can have a cleaning mode for cleaning the fixing members, in which the recording material is pinched by the nip, and the recording sheet is conveyed by repeating rotation and stoppage of the rotatable fixing member.

A further object of the present invention is to provide a storage medium for storing, _in a computer readable condition, a program including a step for causing a sheet to be pinched by a nip between a pair of fixing members at least one of which is rotatable and a step for conveying the sheet by repeating rotation and stoppage of the rotatable fixing member.

The other object of the present invention will be apparent from the following detailed explanation of the invention.

DETAILED DESCRIPTION OF THE PREFERRED EMBODIMENTS

The present invention will now be explained in connection with embodiments thereof with reference to the accompanying drawings.

<First Embodiment>

Figure 1:
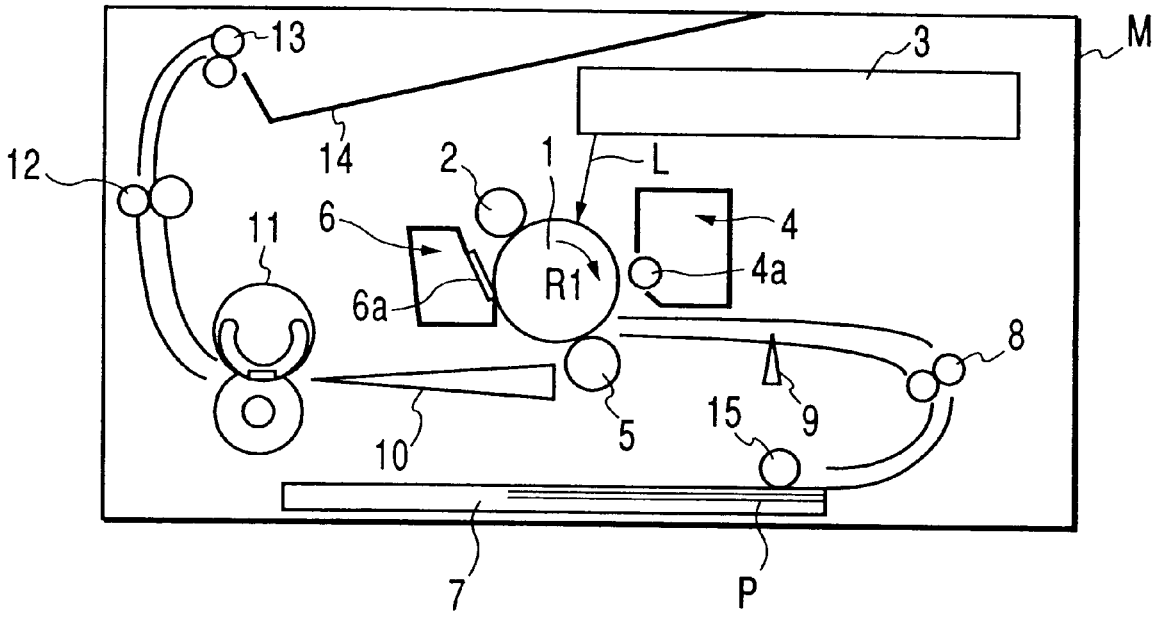
FIG. 1 is a schematic elevational sectional view of an image forming apparatus having a fixing apparatus according to the present invention.

FIG. 1 shows an image forming apparatus having a fixing apparatus according to the present invention. Incidentally, FIG. 1 is a schematic elevational sectional view showing a laser beam printer as an example of the image forming apparatus according to the present invention. First of all, referring to FIG. 1, a construction of the laser beam printer (referred to as "image forming apparatus" hereinafter) will be explained.

The laser beam printer shown in FIG. 1 includes a drum-shaped electrophotographic photosensitive member (referred to as "photosensitive drum" hereinafter) 1 as an image bearing member. The photosensitive drum 1 is rotatably supported by a main body M of the apparatus and is rotated by a drive means (not shown) at a predetermined process speed in a direction shown by the arrow R1.

Around the photosensitive drum 1, along a rotational direction thereof, there are disposed a charge roller (charging device) 2, an exposure means 3, a developing device 4, a transfer roller (transfer device) 5 and a cleaning device 6 in this order.

A sheet supply cassette 7 for containing sheets (such as paper sheets) P is disposed at a lower part of the main body M, and, along a sheet convey path, there are disposed, in order, a sheet supply roller 15, convey rollers 8, a top sensor 9, a convey guide 10, a fixing apparatus 11 according to the present invention, convey rollers 12, discharge rollers 13, and a discharge tray 14.

Next, an operation of the image forming apparatus will be explained.

The photosensitive drum 1 rotated by the drive means (not shown) in the direction R1 is uniformly charged by the charge roller 2 with predetermined polarity and predetermined potential. After the charging, the photosensitive drum 1 is subjected to image exposure L from the exposure means 3 such as a laser optical system in response to image information, thereby removing charges from the exposed portion to form an electrostatic latent image. The electrostatic latent image is developed by the developing device 4. The developing device 4 has a developing roller 4*a*. By applying developing bias to the developing device 4, toner is adhered to the electrostatic latent image to develop (visualize) the latter as a toner image.

The toner image is transferred onto the sheet P by the transfer roller 5. The sheet P is supplied from the sheet supply cassette 7 by the sheet supply roller 15 and is conveyed by the convey rollers 8. Then, the sheet is passed by the top sensor 9 to enter into a transfer nip between the photosensitive drum 1 and the transfer roller 5. In this case, a tip end of the sheet P is detected by the top sensor 9, thereby synchronizing the sheet with the toner image on the photosensitive drum 1. Transfer bias is applied to the transfer roller 5, with the result that the toner image on the photosensitive drum 1 is transferred onto a predetermined position on the sheet P.

The sheet P to which the non-fixed toner image was transferred is sent, along the convey guide 10, to the fixing apparatus 11 (fully described later), where the non-fixed toner image is heated and pressurized to be fixed to the surface of the sheet P. The sheet to which the toner image was fixed is conveyed by the convey rollers 12 and is discharged, by the discharge rollers 13, onto the discharge tray 14 provided on an upper surface of the image forming apparatus. On the other hand, after the toner image was transferred, toner (residual toner) remaining on the photosensitive drum 1 is removed by a cleaning blade 6*a* of the cleaning device 6 for preparation for next image formation.

By repeating the above operations, the images are successively formed.

Figure 2:
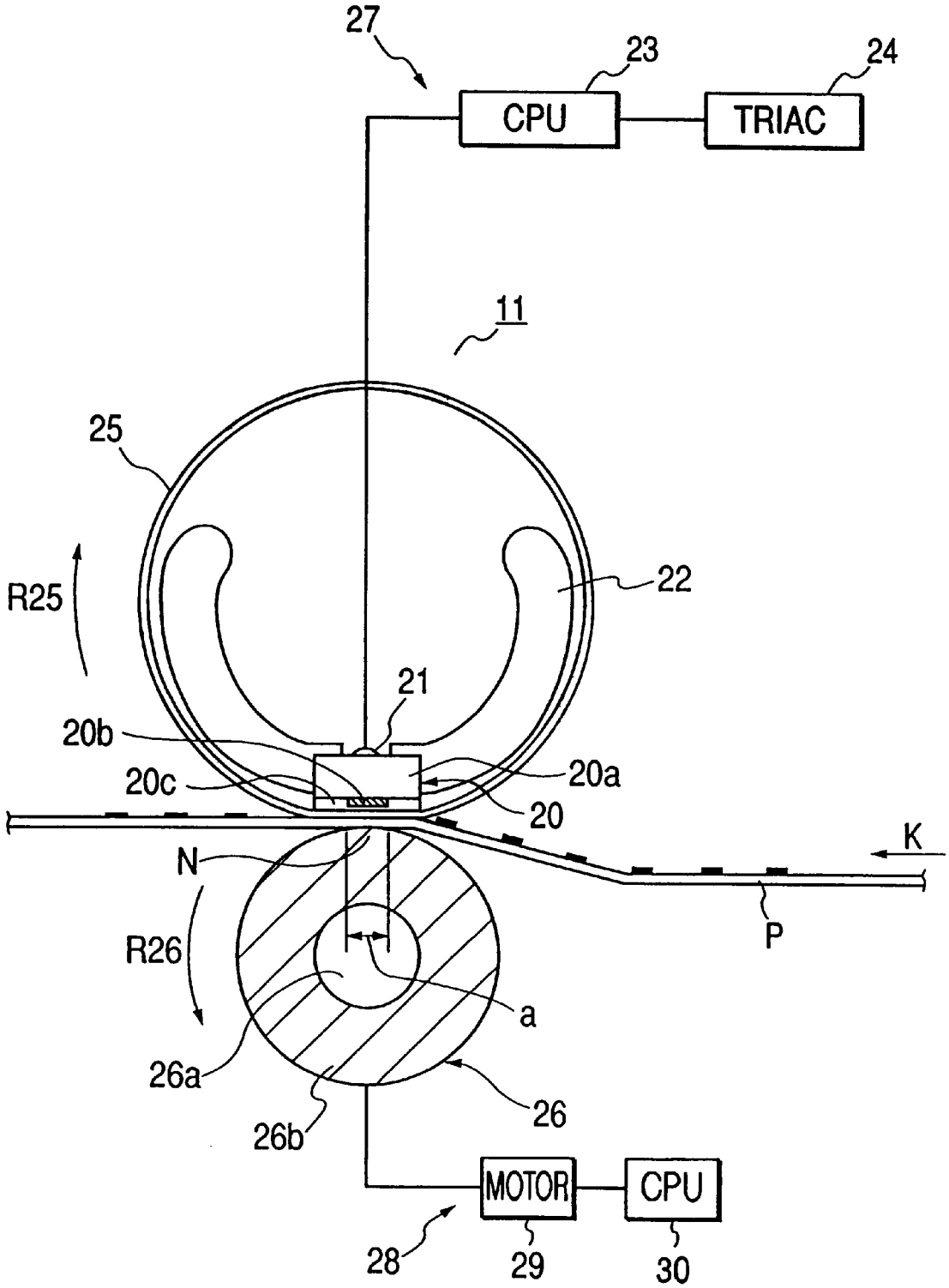
FIG. 2 is an elevational sectional view of the fixing apparatus according to the present invention.

Next, referring to FIG. 2, an example of the fixing apparatus 11 according to the present invention will be fully described. Incidentally, FIG. 2 is an elevational sectional view taken along a sheet conveying direction (shown by the arrow K).

The fixing apparatus 11 shown in FIG. 2 mainly comprises a fixing film (film-shaped fixing rotary member) 25, a pressure roller (fixing rotary member) 26 urged against the fixing film 25, a ceramic heater (heater) 20 for heating the toner through the fixing film 25, a temperature control means 27 for controlling a temperature of the ceramic heater 20, and a rotation control means 28 for controlling conveyance of the sheet P.

The ceramic heater 20 is a resistance heating body and is constituted by forming a resistance pattern 20*b* on a heat-resistive substrate 20*a* made of alumina by a printing technique and by coating the surface of the substrate by a glass layer 20*c*. The ceramic heater is elongated along a left-and-right direction (perpendicular to the plane of FIG. 2) with respect to the sheet conveying direction (shown by the arrow K) so that the heater is longer than a width of the sheet P. The ceramic heater 20 is supported by a heater holder 22 attached to the main body M. The heater holder 22 is formed from heat-resistive resin in a semi-circular shape and acts as a guide member for guiding the rotation of the fixing film 25.

The fixing film 25 has heat capacity smaller than that of the pressure roller 26 and is formed from heat-resistive resin such as polyimide in a cylindrical shape, and mold releasing layer made of fluororesin are provided on the surface of the film. A total thickness of the fixing film 25 is 100 $\mu$m or less. The fixing film is freely mounted around the ceramic heater 20 and the heater guide 22. The fixing film 25 is urged against the ceramic heater 20 by the pressure roller 26 (described later) so that the rear surface of the fixing film 25 is urged against the lower surface of the ceramic heater 20. The fixing film 25 is rotated in a direction shown by the arrow R25 as the sheet P is conveyed in the direction K by rotation of the pressure roller 26 in a direction shown by the arrow R26. Incidentally, left and right ends of the fixing film 25 are regulated by guide portions (not shown) of the heater holder 22 so that the film is not deviated along the longitudinal direction of the ceramic heater 20. Further, grease is coated on the inner surface of the fixing film 25 to reduce sliding resistance between the fixing film and the ceramic heater 20/heater guide 22.

The pressure roller 26 is constituted by a metallic core cylinder 26*a*, and an elastic heat-resistive mold releasing layer 26*b* made of silicone rubber and coated on the core cylinder. The fixing film 25 is urged against the ceramic heater 20 by the mold releasing layer 26*b* from the below to form a fixing nip N between the fixing film and the pressure roller. A width (nip width) a of the pressure roller 26 at the fixing nip N in a rotational direction thereof (i.e., sheet conveying direction) is selected so that the toner on the sheet P can be heated and pressurized appropriately.

The rotation control means 28 includes a motor 29 for rotatingly driving the pressure roller 26, and a CPU 30 for controlling rotation of the motor 29. For example, a stepping motor is used as the motor 29 so that the pressure roller can be rotated in the direction R26 continuously or can be rotated intermittently by a predetermined angle. That is to say, the sheet P can be conveyed in a step-by-step fashion by repeating the rotation and stoppage of the pressure roller 26.

The temperature control means 27 includes a thermistor (temperature detect means) 21 attached to the rear surface of the ceramic heater 20, and a CPU 23 for controlling a Triac 24 on the basis of the temperature of the heater detected by the thermistor 21 to control energization of the ceramic heater 20.

As mentioned above, in the fixing apparatus 11, while the sheet (recording material) P bearing the non-fixed toner is being conveyed through the fixing nip by the rotation of the pressure roller 26 in the direction R26, the toner on the sheet is heated by the ceramic heater 20. In this case, by controlling the rotation of the pressure roller 26 by means of the rotation control means 28, the conveyance of the sheet P can be controlled appropriately, and, the temperature of the ceramic heater 20 can be controlled appropriately.

Next, the cleaning for the fixing apparatus 11 will be explained with reference to a flow chart shown in FIG. 3. Incidentally, regarding the fixing apparatus 11, a mode for performing the normal fixing operation is referred to as "fixing mode", and a mode for performing the cleaning is referred to as "cleaning mode".

First of all, in a starting condition (S1), the fixing apparatus 11 is in a waiting condition. In this condition, when the operator desires the cleaning, the image forming apparatus is switched to the cleaning mode (S2) by a signal from an operation panel on the main body M or a host computer (not shown). In the cleaning mode of the image forming apparatus, a cleaning sheet (which means a sheet P used for the cleaning, and, in the illustrated, is the same as the normal sheet P; referred to as "paper sheet" hereinafter) starts to be supplied (S3), so that the single paper sheet is sent to the fixing apparatus 11 without forming the image on the sheet. In this case, the word "cleaning was completed" may be recorded on the sheet.

A time when a tip end of the paper sheet reaches the fixing nip N (referred to merely as "nip N" hereinafter) can be calculated on the basis of the conveying speed of the paper sheet and a time when the tip end passes through the top sensor 9, and, similarly, a time when the tip end of the paper sheet leaves the nip N can be calculated. Incidentally, detection whether or not the tip end of the paper sheet leaves the nip N may be effected by detecting the tip end of the paper sheet by means of a sensor disposed at a downstream side of the nip. When the fact that the tip end of the paper sheet leaves the nip N is detected (S4), the motor 29 is stopped to stop the rotations of the fixing film 25 and the pressure roller 26, and the energization to the ceramic heater 20 (referred to merely as "heater 20" hereinafter) is turned ON (S5), and a time t of a timer is set to zero and the heating of the nip is started by the heater 20 (S6, S7).

Figure 3:
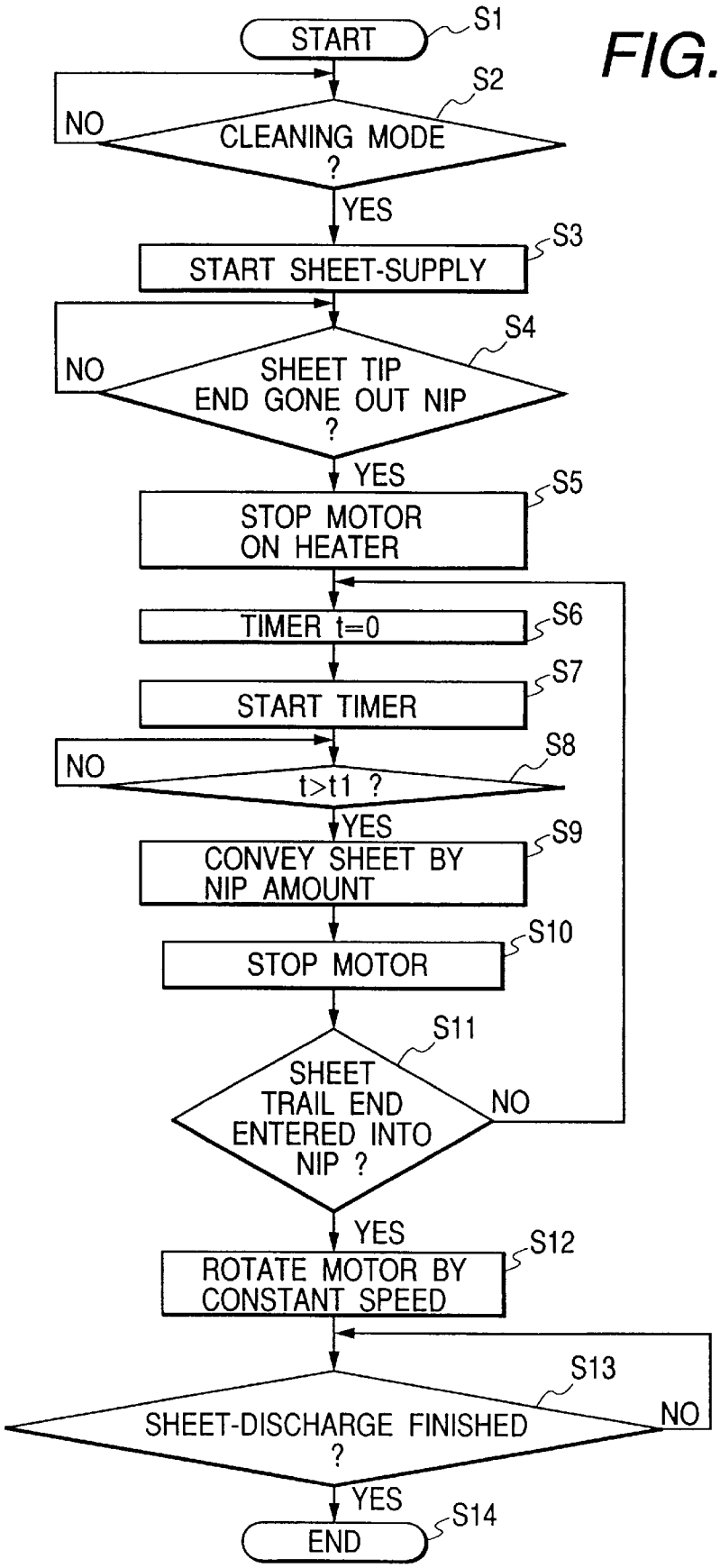
FIG. 3 is a flow chart for explaining a cleaning operation according to a first embodiment of the present invention.

In the flow chart shown in FIG. 3, while the heater 20 is turned ON at this point, the heater may be previously turned ON so that the temperature is adjusted to a temperature lower than that in the printing process, thereby reducing the sliding torque of the fixing film 25. This utilizes the principle that viscosity of grease coated on the inner surface of the fixing film 25 is decreased by increasing the temperature. Further, in order to facilitate the adhesion of adhered matters such as toner adhered to the surface of the pressure roller onto the cleaning sheet by softening the adhered matters, the surface of the pressure roller 26 may be heated to some extent before the paper sheet enters into the nip N. In this case, in a condition that the temperature of the heater 20 is maintained to the temperature in the printing operation, the pressure roller 26 must be rotated by several revolutions.

In any cases, at the same time when the motor 29 is stopped (that is, the rotations of the fixing film 25 and the pressure roller 26 are stopped), the count of the timer is started. It is judged whether the time t of the timer exceeds a time period t1 during which the toner adhered to the surface of the pressure roller 26 is softened to permit the adhesion of the toner onto the paper sheet (S8). Alternatively, it may be judged whether the temperature of the heater 20 detected by the thermistor exceeds a predetermined temperature. The predetermined temperature is preferably a softening point or a melting point of the toner (a method for measuring the softening point will be-described later). After the adhered matters on the surface of the pressure roller is once softened in this way, when the paper sheet is conveyed by an amount corresponding to the nip width a by driving the motor 29 (S9), the adhered matters are peeled from the surface of the pressure roller 26 and is transferred onto the rear surface of the paper sheet.

In this way, by softening the toner on the surface of the pressure roller 26, the softened toner can enter the unevenness surface of the paper sheet to adhere the toner to the paper sheet.

By repeating the softening of the adhered matters and the conveyance of the paper sheet by the nip width amount during one revolution of the pressure roller 26, the entire surface of the pressure roller 26 can be cleaned.

In the illustrated embodiment, after the paper sheet is conveyed by the amount corresponding to the nip width a in the step S9, the motor 29 is stopped to stop the rotations of the pressure roller 26 and the fixing film 25 (S10). The steps S6 to S10 are repeated until a trail end of the paper sheet enters into the nip N.

When the trail end of the cleaning sheet enters into the nip N (S11), the motor 29 is rotated at the normal constant speed (S12). When it is judged that the sheet leaves the nip N (S13), the-cleaning mode is finished (S14). The timing for finishing the cleaning mode may be selected to a time not only after the trail end of the paper sheet enters into the nip but also when the entire surface of the pressure roller 26 is stopped within the nip by at least one time.

Next, the method for measuring the softening point of the toner will be explained. The softening point is referred to as a temperature To measured by the following method. Of course, the measuring method may be modified on the basis of the method used in the present invention. The measurement was effected as follows. A flow-tester CFT-500 A type (manufactured by Shimazu Seisakusho Co., Ltd.) was used, and extrusion load of 20 kg was applied to a die (nozzle) having a diameter of 0.2 mm and a thickness of 1.0 mm so that a plunger descent amount—temperature curve regarding the toner (referred to as "softening S-curve" hereinafter) described when the temperature is increased constantly at a speed of 6° C./min after pre-heating time of 300 second at an initial set temperature of 70% is sought. As the toner, purified toner of 1 to 3 grams was used and the sectional area of the plunger was selected to 1.0 $cm^2$.

Figure 13:
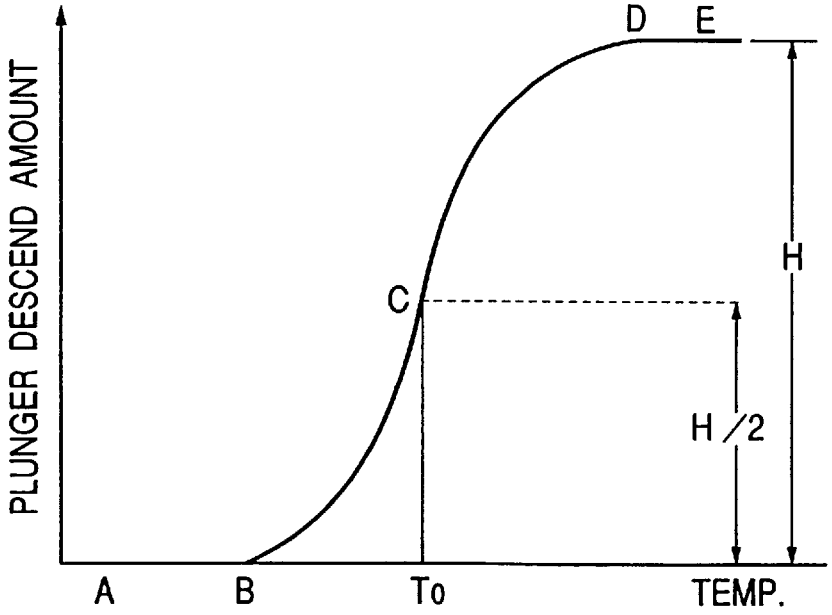
FIG. 13 is a view for explaining a softening point of toner.

The softening S-curve normally describes a curve as shown in FIG. 13. As the temperature is increased at the constant rate, the toner is gradually heated and flow of toner is started (plunger descent A→B). When the temperature is further increased, the toner becomes a fused condition to flow the toner greatly (B→C→D), and the plunger descent is finished (D→E). A height H of the softening S-curve indicates the total flow amount, and a temperature $T_0$ at a point C corresponding to H/2 indicates the softening point In the embodiments 1, 2, 3, 4, 5, 6, 7 and 8, the toner having the softening point of about 110° C. was used.

Next, embodying examples of the first embodiment will be explained.

<Embodying example 1>

Explanation is effected regarding an image forming apparatus in which the conveying speed of the sheet is selected to 50 mm/sec, the diameter of the pressure roller 26 is selected to 25 mm, the rubber thickness of the mold releasing layer 26*b* of the pressure roller 26 is selected to 3 mm, the nip width a is selected to 5 mm, and a distance from the top sensor 9 to the center of the nip is selected to 150 mm. During the normal printing operation, the temperature of the heater 20 is controlled to maintain 150° C. to 190° C. The reason is that the heat is uniformly supplied to the sheet by controlling the heater 20 to the high temperature condition regarding the condition that the pressure roller 26 is cooled and to the low temperature condition regarding the condition that the pressure roller 26 is warmed. Explaining with reference to the flow chart shown in FIG. 3, after the sheet supply is started, the sheet starts to go out the nip N when a time period of (150+2.5)/50 seconds is elapsed after the tip end of the sheet leaves the top sensor 9 (S4).

At this point, the motor 29 is stopped to trap the sheet within the nip. In this condition, the heating is started. The heating control temperature is selected to 190° C. higher than the softening point of the toner, and, after energization is effected by one second, the motor 29 is driven again to feed the sheet by an amount corresponding to the nip width a of 5 mm. Thereafter, the motor 29 is stopped again. Such step-by-step feeding process in which the motor is stopped after the sheet is fed by the nip width amount is repeated for one revolution of the pressure roller 26 or more. In case of the embodying example 1, since the outer peripheral length of the pressure roller 26 is 78.5 mm, it is required that the step-by-step feeding process is repeated by sixteen times or more.

When the trail end of the sheet enters into the nip N, the step-by-step feeding process is finished, and the sheet is conveyed and discharged at a constant speed. Then, the motor is stopped. In this method, it was found that toner contamination adhered to the pressure roller 26 is removed by 90% or more and the residual toner of 10% is not peeled from the pressure roller 26 to adhere to the sheet during the normal printing operation, thereby achieving the excellent cleaning efficiency.

<Embodying example 2>

In an embodying example 2, the pressure roller 26 is warmed before the sheet enters into the nip N to improve the cleaning ability and to reduce the cleaning time.

Explaining with reference to the flow chart shown in FIG. 3, after the sheet supply is started, before the sheet enters into the nip N, the heater 20 is controlled to 190° C. The tip end of the sheet starts to go out the nip N when a time period of (150+2.5)/50 seconds is elapsed after the tip end of the sheet leaves the top sensor 9 (S4).

At this point, the motor 29 is stopped to trap the sheet within the nip. In this condition, the heating is started. The heating control temperature is selected to 190° C. higher than the softening point of the toner, and, after energization is effected by 0.5 second, the motor 29 is driven again to feed the sheet by an amount of 5 mm. Thereafter, the motor 29 is stopped again (step-by-step feeding). Such step-by-step feeding process is repeated for one revolution of the pressure roller 26 or more. Since the outer peripheral length of the pressure roller 26 is 78.5 mm, it is required that the step-by-step feeding process is repeated by sixteen times or more. When the trail end of the sheet enters into the nip N, the step-by-step feeding process is finished, and the sheet is conveyed and discharged at a constant speed. Then, the motor is stopped.

In this method, it was found that toner contamination adhered to the pressure roller 26 is removed by 93% or more and the residual toner of 7% is not peeled from the pressure roller 26 to adhere to the sheet during the normal printing operation, thereby achieving the excellent cleaning efficiency.

In the above-mentioned embodying example 1, while about 27 seconds (including start/stop times of the motor 29) was required for the cleaning of one revolution of the pressure roller 26, in the embodying example 2, since the pressure roller can be cleaned by about 19 seconds, the cleaning time can be reduced greatly.

<Second Embodiment>

In a second embodiment of the present invention, the first embodiment is improved to further enhance the cleaning ability. The toner, and a dimensional relation of the image forming apparatus and the fixing apparatus used in the second embodiment are the same as the first embodiment.

The control in the second embodiment will be explained with reference to a flow chart shown in FIG. 4. A difference from the first embodiment is that the energization of the heater is turned OFF while the motor is stopped.

First of all, in a starting condition (S21), the fixing apparatus 11 is in a waiting condition. In this condition, when the operator desires the cleaning, the image forming apparatus is switched to the cleaning mode (S22) by a signal from an operation panel on the main body M or a host computer (not shown). In the cleaning mode of the image forming apparatus, a cleaning sheet (which means a sheet P used for the cleaning, and, in the illustrated, is the same as the normal sheet P; referred to as "paper sheet" hereinafter) starts to be supplied (S23), so that the single paper sheet is sent to the fixing apparatus 11 without forming the image on the sheet. In this case, the word "cleaning was completed" may be recorded on the sheet.

A time when a tip end of the paper sheet reaches the fixing nip N (referred to merely as "nip N" hereinafter) can be calculated on the basis of the conveying speed of the paper sheet and a time when the tip end passes through the top sensor 9, and, similarly, a time when the tip end of the paper sheet leaves the nip N can be calculated. Incidentally, detection whether or not the tip end of the paper sheet leaves the nip N may be effected by detecting the tip end of the paper sheet by means of a sensor disposed at a downstream side of the nip. When the fact that the tip end of the paper sheet leaves the nip N is detected (S24), the motor 29 is stopped to stop the rotations of the fixing film 25 and the pressure roller 26 (S25), and the energization to the ceramic heater 20 (referred to merely as "heater 20" hereinafter) is turned ON, and a time t of a timer is set to zero and the heating of the nip is started by the heater 20 (S26, S27).

Figure 4:
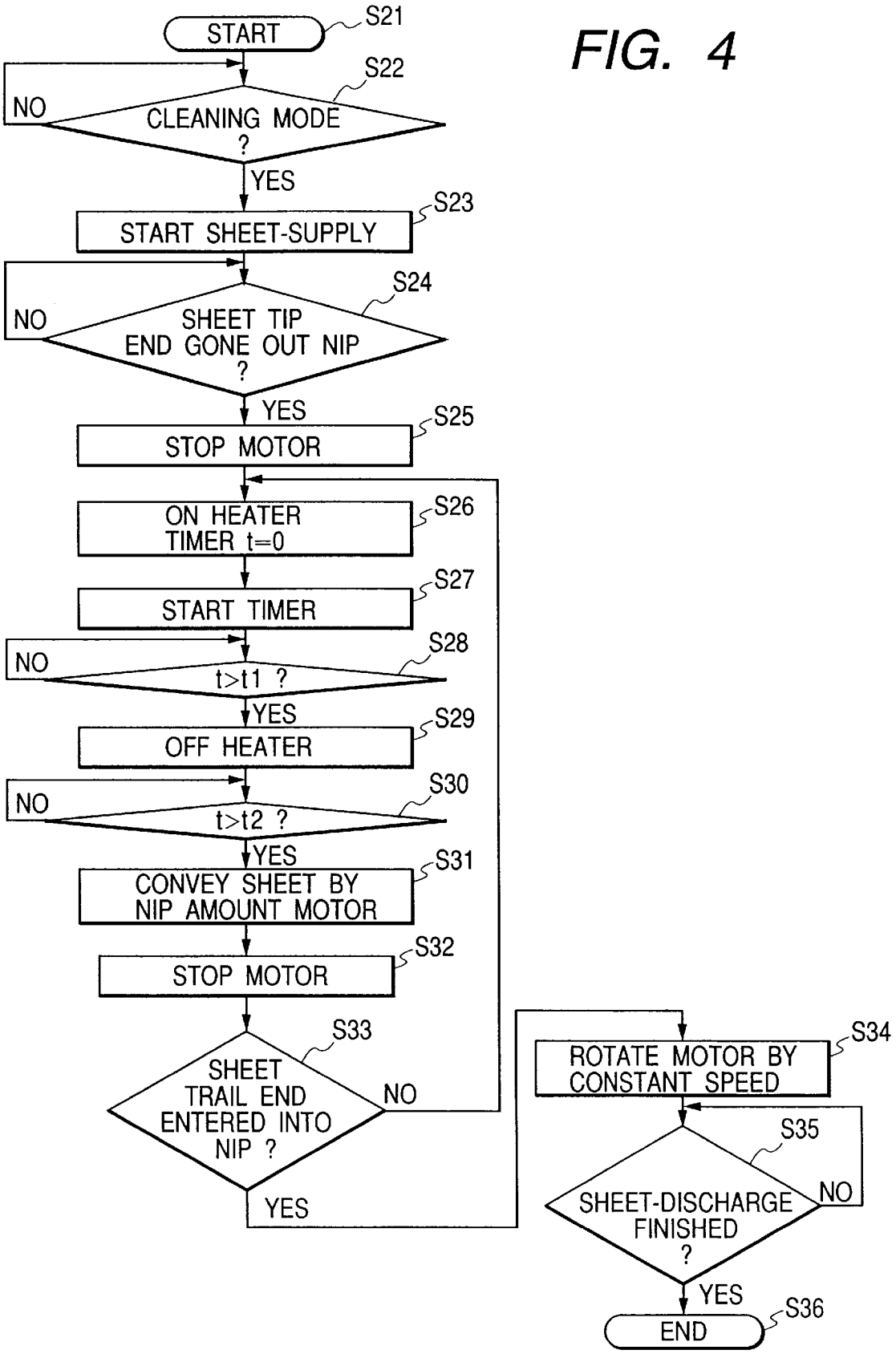
FIG. 4 is a flow chart for explaining a cleaning operation according to a second embodiment of the present invention.

In the flow chart shown in FIG. 4, while the heater 20 is turned ON at this point, the heater may be previously turned ON so that the temperature is adjusted to a temperature lower than that in the printing process, thereby reducing the sliding torque of the fixing film 25. This utilizes the principle that viscosity of grease coated on the inner surface of the fixing film 25 is decreased by increasing the temperature. Further, in order to facilitate the adhesion of adhered matters such as toner adhered to the surface of the pressure roller onto the cleaning sheet by softening the adhered matters, the surface of the pressure roller 26 may be heated to some extent before the paper sheet enters into the nip N. In this case, in a condition that the temperature of the heater 20 is maintained to the temperature in the printing operation, the pressure roller 26 must be rotated by several revolutions.

In any cases, at the same time when the motor 29 is stopped (that is, the rotations of the fixing film 25 and the pressure roller 26 are stopped), the count of the timer is started. It is judged whether the time t of the timer exceeds a heating time period t1 during which the toner adhered to the surface of the pressure roller 26 is softened to permit the adhesion of the toner onto the paper sheet (S28). Alternatively, it may be judged whether the temperature of the heater 20 detected by the thermistor exceeds a predetermined temperature. The predetermined temperature is preferably a softening point or a melting point of the toner. After the adhered matters on the surface of the pressure roller is once softened in this way, the energization to the heater 20 is turned OFF to achieve a non-heating condition (S29), and it is waiting until the temperature of the heater 20 lowers below a predetermined temperature. The predetermined temperature may be the softening point of the toner as long as it makes the toner temperature lower than the softening point. In the illustrated embodiment, it is judged whether the count value of the timer exceeds a predetermined time t2 (time period during which the heater temperature lowers below the predetermined temperature) (S30). Incidentally, it may be judged whether or not the temperature detected by the thermistor is a predetermined temperature lower than the softening point of the toner.

When the adhered matters on the pressure roller 26 is cooled in this way within the nip, due to difference in surface roughness and surface energy between the pressure roller 26 and the paper sheet, the adhered matters are adhered to the paper sheet more firmly than the pressure roller 26. That is to say, the adhered matters which were adhered to the surface of the pressure roller 26 before the softening are adhered to the paper sheet more strongly than the pressure roller after the softening/cooling. Then, when the paper sheet is conveyed by an amount corresponding to the nip width a by driving the motor 29 (S31), the adhered matters are peeled from the surface of the pressure roller 26 and is transferred onto the rear surface of the paper sheet.

In this way, by softening the toner on the surface of the pressure roller 26 during the stoppage of the paper sheet, the softened toner can enter the unevenness surface of the paper sheet to adhere the toner to the paper sheet. To this end, although the paper sheet may be fed as it is, it is more effective that, after the toner is softened and then cooled, the paper sheet is fed. By cooling the toner once, the toner entered into the unevenness surface of the paper sheet is solidified to firmly adhere the toner to the paper sheet, thereby improving the cleaning effect and prevent the sheet jam or folding of sheet which would otherwise caused by an obstacle formed by the toner dropped from the paper sheet during the conveyance.

By repeating the softening and cooling of the adhered matters and the conveyance of the paper sheet by the nip width amount during one revolution of the pressure roller 26, the entire surface of the pressure roller 26 can be cleaned.

In the illustrated embodiment, after the paper sheet is conveyed by the amount corresponding to the nip width a in the step S31, the motor 29 is stopped to stop the rotations of the pressure roller 26 and the fixing film 25 (S32). The steps S26 to S32 are repeated until a trail end of the paper sheet enters into the nip N.

When the trail end of the cleaning sheet enters into the nip N (S33), the motor 29 is rotated at the normal constant speed (S34). When it is judged that the sheet leaves the nip N (S35), the cleaning mode is finished (S36). The timing for finishing the cleaning mode may be selected to a time not only after the trail end of the paper sheet enters into the nip but also when the entire surface of the pressure roller 26 is stopped within the nip by at least one time.

Next, embodying examples of the second embodiment will be explained.

<Embodying example 1>

Explanation is effected regarding an image forming apparatus in which the conveying speed of the sheet is selected to 50 mm/sec, the diameter of the pressure roller 26 is selected to 25 mm, the rubber thickness of the mold releasing layer 26*b* of the pressure roller 26 is selected to 3 mm, the nip width a is selected to 5 mm, and a distance from the top sensor 9 to the center of the nip is selected to 150 mm. During the normal printing operation, the temperature of the heater 20 is controlled to maintain 150° C. to 190° C. The reason is that the heat is uniformly supplied to the sheet by controlling the heater 20 to the high temperature condition regarding the condition that the pressure roller 26 is cooled and to the low temperature condition regarding the condition that the pressure roller 26 is warmed. Explaining with reference to the flow chart shown in FIG. 4, after the sheet supply is started, the sheet starts to go out the nip N when a time period of (150+2.5)/50 seconds is elapsed after the tip end of the sheet leaves the top sensor 9 (S24).

At this point, the motor 29 is stopped to trap the sheet within the nip. In this condition, the heating is started. The heating control temperature is selected to 190° C. higher than the softening point of the toner, and, after energization is effected by one second, the energization is turned OFF finish the heating, and, after 0.5 second is elapsed, when the heater temperature is decreased up to 130° C., the motor 29 is driven again to feed the sheet by an amount corresponding to the nip width a of 5 mm. Thereafter, the motor 29 is stopped again. Such heating and cooling process is repeated for one revolution of the pressure roller 26 or more. In case of the embodying example 1, since the outer peripheral length of the pressure roller 26 is 78.5 mm, it is required that the step-by-step feeding process is repeated by sixteen times or more.

When the trail end of the sheet enters into the nip N, the step-by-step feeding process is finished, and the sheet is conveyed and discharged at a constant speed. Then, the motor is stopped. In this method, it was found that toner contamination adhered to the pressure roller 26 is removed by 95% or more and the residual toner of 5% is not peeled from the pressure roller 26 to adhere to the sheet during the normal printing operation, thereby achieving the excellent cleaning efficiency.

<Embodying example 2>

In an embodying example 2, the pressure roller 26 is warmed before the sheet enters into the nip N to improve the cleaning ability and to reduce the cleaning time.

Explaining with reference to the flow chart shown in FIG. 4, after the sheet supply is started, before the sheet enters into the nip N, the heater 20 is controlled to 190° C. The tip end of the sheet starts to go out the nip N when a time period of (150+2.5)/50 seconds is elapsed after the tip end of the sheet leaves the top sensor 9 (S24).

At this point, the motor 29 is stopped to trap the sheet within the nip. In this condition, the heating is started. The heating control temperature is selected to 190° C., and, after energization is effected by 0.5 second, the energization is turned OFF, and, after 0.5 second is elapsed, when the heater temperature is decreased up to 130° C., the motor 29 is driven again to feed the sheet by an amount of 5 mm. Thereafter, such heating and cooling process is repeated for one revolution of the pressure roller 26 or more. Since the outer peripheral length of the pressure roller 26 is 78.5 mm, it is required that the process is repeated by sixteen times or more. When the trail end of the sheet enters into the nip N, the step-by-step feeding process is finished, and the sheet is conveyed and discharged at a constant speed. Then, the motor is stopped.

In this method, it was found that toner contamination adhered to the pressure roller 26 is removed by 98% or more and the residual toner of 2% is not peeled from the pressure roller 26 to adhere to the sheet during the normal printing operation, thereby achieving the excellent cleaning efficiency.

In the above-mentioned embodying example 1, while about 35 seconds (including heating/cooling time of 24.0 seconds and start/stop times of the motor 29) was required for the cleaning of one revolution of the pressure roller 26, in the embodying example 2, since the pressure roller can be cleaned by about 27 seconds, the cleaning time can be reduced greatly.

<Third Embodiment>

In a third embodiment of the present invention, the first and second embodiments are improved to further enhance the cleaning ability. The toner, and a dimensional relation of the image forming apparatus and the fixing apparatus used in the third embodiment are the same as the second embodiment.

The control in the third embodiment will be explained with reference to a flow chart shown in FIG. 5. A difference from the first and second embodiments is that, after the entire one revolution surface of the pressure roller 26 is stopped within the nip by at least one time, the heater control temperature is increased.

First of all, in a starting condition (S41), the fixing apparatus 11 is in a waiting condition. In this condition, when the operator desires the cleaning, the image forming apparatus is switched to the cleaning mode (S42) by a signal from an operation panel on the main body M or a host computer (not shown). In the cleaning mode of the image forming apparatus, a single sheet starts to be supplied (S43), so that the single paper sheet is sent to the fixing apparatus 11 without forming the image on the sheet. In this case, the word "cleaning was completed" may be recorded on the sheet.

A time when a tip end of the paper sheet reaches the nip N can be calculated on the basis of the conveying speed of the paper sheet and a time when the tip end passes through the top sensor 9, and, similarly, a time when the tip end of the paper sheet leaves the nip N can be calculated. Incidentally, detection whether or not the tip end of the paper sheet leaves the nip N may be effected by detecting the tip end of the paper sheet by means of a sensor disposed at a downstream side of the nip. When the fact that the tip end of the paper sheet leaves the nip N is detected (S44), the motor 29 is stopped (S45), and the heater 20 is turned ON, and a time t of a timer is set to zero and the heating of the nip is started by the heater 20 (S46, S47).

Figure 5:
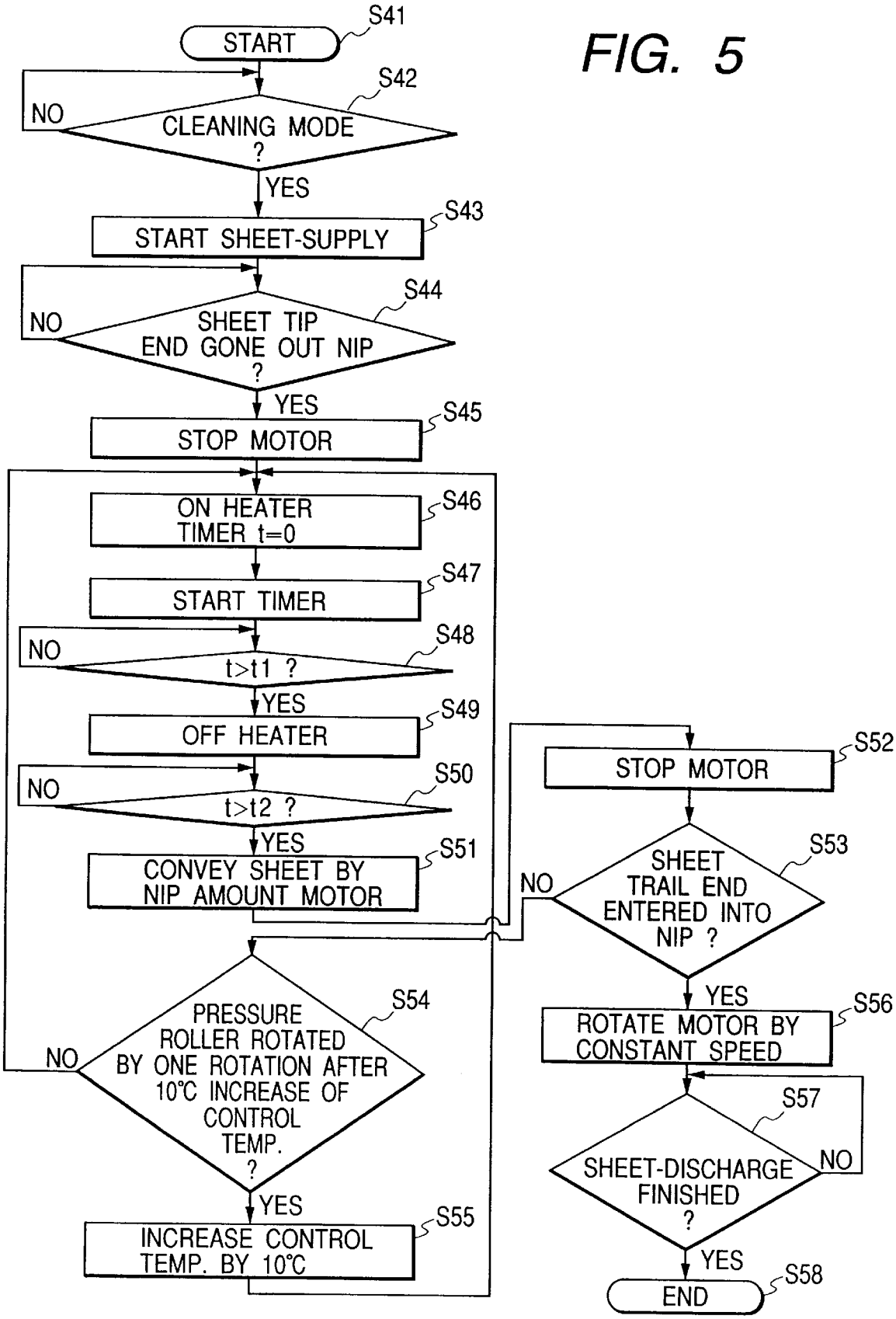
FIG. 5 is a flow chart for explaining a cleaning operation according to a third embodiment of the present invention.

In the flow chart shown in FIG. 5, while the heater 20 is turned ON at this point, the heater may be previously turned ON so that the temperature is adjusted to a temperature lower than that in the printing process, thereby reducing the sliding torque of the fixing film 25. This utilizes the principle that viscosity of grease coated on the inner surface of the fixing film 25 is decreased by increasing the temperature. Further, in order to facilitate the adhesion of adhered matters such as toner adhered to the surface of the pressure roller onto the cleaning sheet by softening the adhered matters, the surface of the pressure roller 26 may be heated to some extent before the paper sheet enters into the nip N. In this case, in a condition that the temperature of the heater 20 is maintained to the temperature in the printing operation, the pressure roller 26 must be rotated by several revolutions.

In any cases, at the same time when the motor 29 is stopped, the count of the timer is started. It is judged whether the time t of the timer exceeds a heating time period t1 during which the toner adhered to the surface of the pressure roller 26 is softened to permit the adhesion of the toner onto the paper sheet (S48). Alternatively, it may be judged whether the temperature of the heater 20 detected by the thermistor exceeds a predetermined temperature. After the adhered matters on the surface of the pressure roller is once softened in this way, the energization to the heater 20 is turned OFF (S49), and it is waiting until the temperature of the heater 20 lowers below a predetermined temperature. The predetermined temperature is preferably the softening point of the toner. In the illustrated embodiment, it is judged whether the count value of the timer exceeds a predetermined time t2 (time period during which the heater temperature lowers below the predetermined temperature) (S50). Incidentally, it may be judged whether or not the temperature detected by the thermistor is a predetermined temperature.

When the adhered matters on the pressure roller 26 is cooled in this way within the nip, due to difference in surface roughness and surface energy between the pressure roller 26 and the paper sheet, the adhered matters are adhered to the paper sheet more firmly than the pressure roller 26. That is to say, the adhered matters which were adhered to the surface of the pressure roller 26 before the softening are adhered to the paper sheet more strongly than the pressure roller after the softening/cooling. Then, when the paper sheet is conveyed by an amount corresponding to the nip width a by driving the motor 29 (S51), the adhered matters are peeled from the surface of the pressure roller 26 and is transferred onto the rear surface of the paper sheet. Then the motor stops (S52).

In this way, by cooling the toner once, the cleaning effect can be improved and the sheet jam or folding of sheet can be prevented, which would otherwise caused by an obstacle formed by the toner dropped from the paper sheet during the conveyance.

By repeating the softening and cooling of the adhered matters and the conveyance of the paper sheet by the nip width amount during one revolution of the pressure roller 26, the entire surface of the pressure roller 26 can be cleaned.

If the trail end of the paper sheet does not yet leave the nip N (S53), after one revolution (rotational amount corresponding to one revolution) cleaning of the pressure roller 26 is finished (S54), the control temperature is further increased by 10° C. (S55). And, the program is returned to the step S46, the one revolution (next rotational amount corresponding to one revolution) cleaning of the pressure roller is effected. In this case, since the pressure roller 26 and the toner contamination adhered to the surface of the pressure roller are further heated in comparison with the previous one revolution cleaning, the toner contamination which could not remove by the previous one revolution cleaning can be removed. In this case, although the temperature of the heater 20 may be increased by several times, since a safety device may be operated if the temperature becomes too high, the increasing amount of the control temperature for each revolution and the number of successive revolutions to be temperature-increased are determined for each apparatus.

Incidentally, in the illustrated embodiment, while an example that after the paper sheet is conveyed by the amount corresponding to the nip width a the motor is stopped was explained, an amount of one step-by-step feeding process may not be correspond to the nip width a. After the entire surface of the pressure roller 26 is stopped within the nip N by at least one time, the control temperature may be increased.

When the trail end of the cleaning sheet enters into the nip N (S53), the motor 29 is rotated at the normal constant speed (S56). When the cleaning sheet is discharged onto the discharge tray 14 through the convey rollers 12 and the discharge rollers 13, it is judged that the cleaning is finished (S57), and the cleaning mode is finished (S58). The reason is that the paper sheet is prevented from being wound around from it trail end thereby to prevent the sheet jam by easily separating the trail end of the sheet from the pressure roller 26.

<Embodying example 1>

Explanation is effected regarding an image forming apparatus in which the conveying speed of the sheet is selected to 50 mm/sec, the diameter of the pressure roller 26 is selected to 25 mm, the rubber thickness of the mold releasing layer 26*b* of the pressure roller 26 is selected to 3 mm, the nip width a is selected to 5 mm, and a distance from the top sensor 9 to the center of the nip is selected to 150 mm. During the normal printing operation, the temperature of the heater 20 is controlled to maintain 150° C. to 190° C. The reason is that the heat is uniformly supplied to the sheet by controlling the heater 20 to the high temperature condition regarding the condition that the pressure roller 26 is cooled and to the low temperature condition regarding the condition that the pressure roller 26 is warmed. Explaining with reference to the flow chart shown in FIG. 5, after the sheet supply is started, the sheet starts to go out the nip N when a time period of (150+2.5)/50 seconds is elapsed after the tip end of the sheet leaves the top sensor 9 (S44).

At this point, the motor 29 is stopped to trap the sheet within the nip. In this condition, the heating is started. The heating control temperature is selected to 190° C., and, after energization is effected by one second, the heating is finished, and, after 0.5 second is elapsed, when the heater temperature is decreased up to 130° C., the motor 29 is driven again to feed the sheet by an amount of 5 mm. Thereafter, such heating and cooling process is repeated for one revolution of the pressure roller 26 or more. In case of the embodying example 1, since the outer peripheral length of the pressure roller 26 is 78.5 mm, it is required that the step-by-step feeding process is repeated by sixteen times or more.

When the cleaning sheet of A4 size is used, the cleaning of 3.78 revolutions of the pressure roller 26 can be effected. In this third embodiment, the first revolution of the pressure roller 26 is cleaned at the temperature of 190° C., the second revolution is cleaned at the temperature of 200° C. and the third revolution is cleaned at the temperature of 210° C. Incidentally, the remaining 0.78 revolution is shared to the tip and trail end portions of the paper sheet.

When the trail end of the sheet enters into the nip N, the step-by-step feeding process is finished, and the sheet is conveyed and discharged at a constant speed. Then, the motor is stopped. In this method, it was found that toner contamination adhered to the pressure roller 26 is removed by 99% or more and the residual toner of 1% is not peeled from the pressure roller 26 to adhere to the sheet during the normal printing operation, thereby achieving the excellent cleaning efficiency.

Incidentally, in the third embodiment, while an example that the energization to the heater is turned OFF during the stoppage of the motor was explained, as is in the first embodiment, even when the energization to the heater is not turned OFF, by increasing the control temperature for each revolution, the cleaning effect can be enhanced.

Further, also in the third embodiment, as is in the second embodiment, the process for warming the surface of the pressure roller 26 before the paper sheet enters into the nip thereby to soften the adhered matters may be added. In the third embodiment, while an example that the control temperature is increased for each revolution of the pressure roller 26 to increase the heat generating amount of the heater per unit time was explained, the heating amount may be increased for each revolution. More specifically, not that the temperature is increased for each revolution, but that the heating time period may be increased for each revolution.

<Fourth Embodiment>

Further, during the continuous sheet pass, when the pressure roller is heated up to the temperature by which the toner contamination on the pressure roller is fused, if the sheet is fed step by step, the sheet may be adhered to the pressure roller from a tip end thereof.

In a fourth embodiment of the present invention, the first to third embodiments are improved to further prevent the sheet from winding around the roller. The toner, and a dimensional relation of the image forming apparatus and the fixing apparatus used in the fourth embodiment are the same as the first to third embodiments. A difference from the first to third embodiments is that the first stoppage of the motor is effected after the tip end of the sheet is pinched between the convey members.

The control in the fourth embodiment will be explained with reference to a flow chart shown in FIG. 6.

First of all, in a starting condition (S61), the fixing apparatus 11 is in a waiting condition. In this condition, when the operator desires the cleaning, the image forming apparatus is switched to the cleaning mode (S62) by a signal from an operation panel on the main body M or a host computer (not shown).

In the cleaning mode of the image forming apparatus, a single sheet starts to be supplied, (S63) so that the single paper sheet is sent to the fixing apparatus 11 without forming the image on the sheet. In this case, the word "cleaning was completed" may be recorded on the sheet.

In the fourth embodiment, after the tip end of the paper sheet reaches the pair of convey rollers 12 (FIG. 1) (pair of convey members) disposed at the fixing apparatus 11, the motor is stopped. A time when the tip end of the paper sheet reaches the pair of convey rollers 12 can be calculated on the basis of the conveying speed of the paper sheet and a time when the tip end passes through the top sensor 9. Incidentally, detection whether or not the tip end of the paper sheet reaches the pair of convey rollers 12 may be effected by detecting the tip end of the paper sheet by means of a sensor disposed immediately at a downstream side of the pair of convey rollers 12.

It is judged whether the tip end of the paper sheet is pinched between the pair of convey rollers 12 (S64). If pinched, the motor 29 is stopped (S65), and the heating of the nip is started by the heater 20 (S66). The reason why the cleaning operation for removing the adhered matters by stopping the pressure roller 26 after the tip end of the paper sheet is pinched between the pair of convey rollers 12 is that the tip end of the cleaning sheet is prevented from being wound around the pressure roller 26 by the conveying force of the pair of convey rollers 12.

Figure 6:
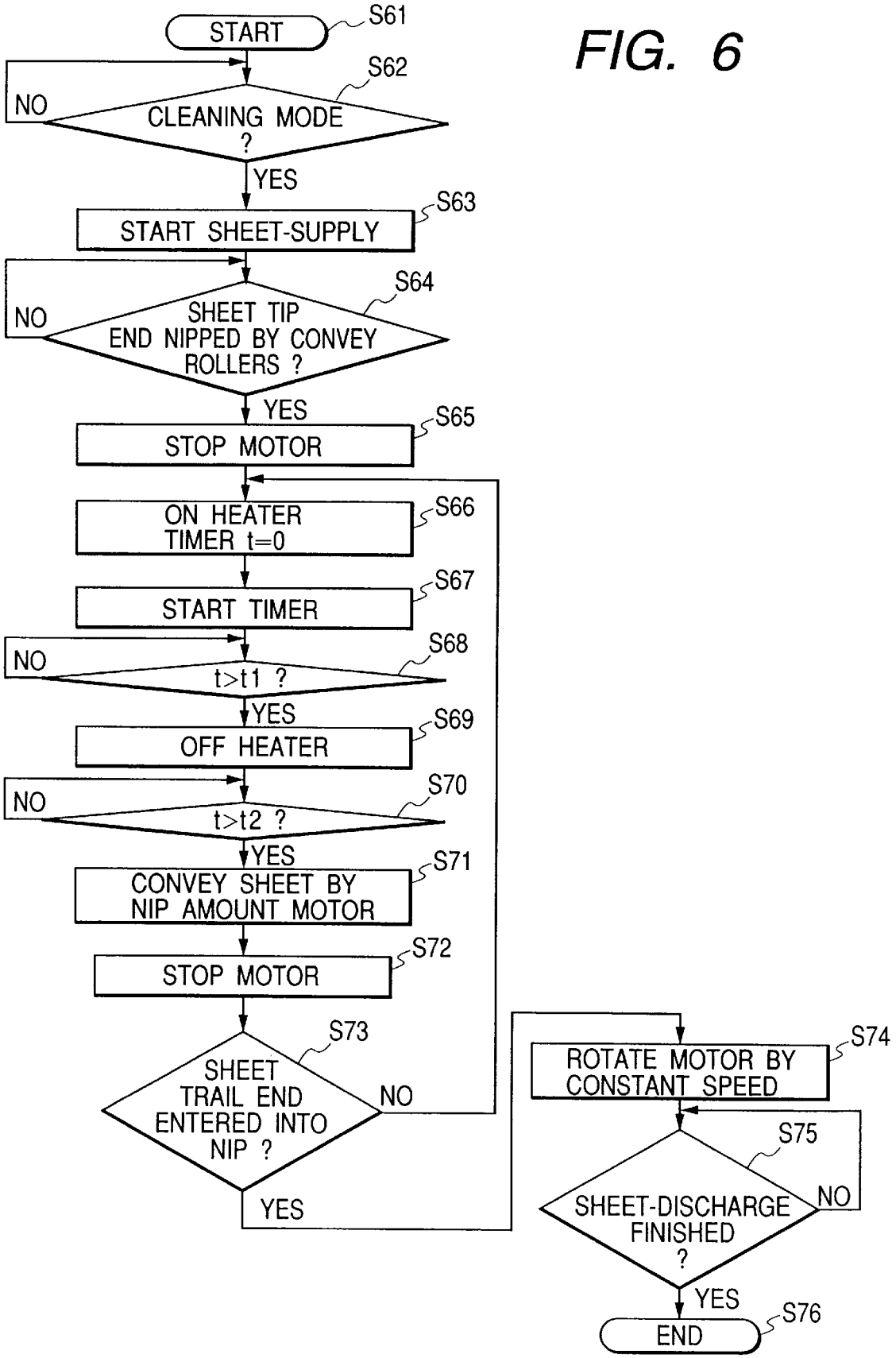
FIG. 6 is a flow chart for explaining a cleaning operation according to a fourth embodiment of the present invention.

In the flow chart shown in FIG. 6, while the heater 20 is turned ON at this point, the heater may be previously turned ON so that the temperature is adjusted to a temperature lower than that in the printing process, thereby reducing the sliding torque of the fixing film 25. This utilizes the principle that viscosity of grease coated on the inner surface of the fixing film 25 is decreased by increasing the temperature. Further, in order to facilitate the adhesion of adhered matters such as toner adhered to the surface of the pressure roller onto the cleaning sheet by softening the adhered matters, the surface of the pressure roller 26 may be heated to some extent before the paper sheet enters into the nip N. In this case, in a condition that the temperature of the heater 20 is maintained to the temperature in the printing operation, the pressure roller 26 must be rotated by several revolutions.

In any cases, at the same time when the motor 29 is stopped, the count of the timer is started (S66, S67). It is judged whether the time t of the timer exceeds a heating time period t1 during which the toner adhered to the surface of the pressure roller 26 is softened to permit the adhesion of the toner onto the paper sheet (S68). Alternatively, it may be judged whether the temperature of the heater 20 detected by the thermistor exceeds a predetermined temperature After the adhered matters on the surface of the pressure roller is once softened in this way, the energization to the heater 20 is turned OFF (S69), and it is waiting until the temperature of the heater 20 lowers below a predetermined temperature. In the illustrated embodiment, it is judged whether the count value of the timer exceeds a predetermined time t2 (time period during which the heater temperature lowers below the predetermined temperature) (S70). Incidentally, also in the fourth embodiment, as is in the third embodiment, in place of the timer, it may be judged whether or not the temperature detected by the themistor is a predetermined temperature.

When the adhered matters on the pressure roller 26 is cooled in this way within the nip, due to difference in surface roughness and surface energy between the pressure roller 26 and the paper sheet, the adhered matters are adhered to the paper sheet more firmly than the pressure roller 26. That is to say, the adhered matters which were adhered to the surface of the pressure roller 26 before the softening are adhered to the paper sheet more strongly than the pressure roller after the softening/cooling. Then, when the paper sheet is conveyed by an amount corresponding to the nip width a by driving the motor 29 (S71), the adhered matters are peeled from the surface of the pressure roller 26 and is transferred onto the rear surface of the paper sheet. The motor stops (S72) In this way, by cooling the toner once, the cleaning effect can be improved and the sheet jam or folding of sheet can be prevented, which would otherwise caused by an obstacle formed by the toner dropped from the paper sheet during the conveyance.

By repeating the softening and cooling of the adhered matters and the conveyance of the paper sheet by the nip width amount during one revolution of the pressure roller 26, the entire surface of the pressure roller 26 can be cleaned.

When the trail end of the cleaning sheet enters into the nip N (S73), the motor 29 is rotated at the normal constant speed (S74). When it is judged that the sheet leaves the nip N (S75), the cleaning mode is finished (S76). The reason is that the paper sheet is prevented from being wound around from its trail end thereby to prevent the sheet jam by easily separating the trail end of the sheet from the pressure roller 26.

<Embodying example 1>

Explanation is effected regarding an image forming apparatus in which the conveying speed of the sheet is selected to 50 mm/sec, the diameter of the pressure roller 26 is selected to 25 mm, the rubber thickness of the mold releasing layer 26*b* of the pressure roller 26 is selected to 3 mm, the nip width a is selected to 5 mm, and a distance from the top sensor 9 to the pair of convey rollers 12 is selected to 200 mm. During the normal printing operation, the temperature of the heater 20 is controlled to maintain 150° C. to 190° C. The reason is that the heat is uniformly supplied to the sheet by controlling the heater 20 to the high temperature condition regarding the condition that the pressure roller 26 is cooled and to the low temperature condition regarding the condition that the pressure roller 26 is warmed. Explaining with reference to the flow chart shown in FIG. 6, after the sheet supply is started, the tip end of the sheet reaches the pair of convey rollers 12 when a time period of 200/50 seconds is elapsed after the tip end of the sheet leaves the top sensor 9 (S64).

At this point, the motor 29 is stopped to trap the sheet within the nip. In this condition, the heating is started. The heating control temperature is selected to 190° C., and, after energization is effected by one second, the heating is finished, and, after 0.5 second is elapsed, when the heater temperature is decreased up to 130° C., the motor 29 is driven again to feed the sheet by an amount of 5 mm. Thereafter, such heating and cooling process is repeated for one revolution of the pressure roller 26 or more. Since the outer peripheral length of the pressure roller 26 is 78.5 mm, it is required that the step-by-step feeding process is repeated by sixteen times or more.

When the trail end of the sheet enters into the nip N, the step-by-step feeding process is finished, and the sheet is conveyed and discharged at a constant speed. Then, the motor is stopped.

In this method, it was found that toner contamination adhered to the pressure roller 26 is removed by 95% or more and the residual toner of 5% is not peeled from the pressure roller 26 to adhere to the sheet during the normal printing operation, thereby achieving the excellent cleaning efficiency.

In the first to third embodiments, if the contamination of the surface of the pressure roller 26 is severe, it fears that the cleaning sheet is wound around the pressure roller 26 to cause the sheet jam. However, according to the fourth embodiment, since the motor is stopped after the tip end of the sheet is pinched between the pair of convey rollers 12, there is no danger of causing the sheet jam.

Incidentally, in the fourth embodiment, while an example that the energization to the heater is turned OFF during the stoppage of the motor was explained, as is in the first embodiment, the energization to the heater may not be turned OFF.

Further, also in the fourth embodiment, as is in the first to third embodiments, the process for warming the surface of the pressure roller 26 before the paper sheet enters into the nip thereby to soften the adhered matters may be added.

<Fifth Embodiment>

A fifth embodiment of the present invention relates to a cleaning mode in which the pressure roller 26 is warmed before the sheet enters into the nip. In the fifth embodiment, after the temperature of the surface of the pressure roller is increased above the softening point of the toner, the sheet supply is started. The toner, and a dimensional relation of the image forming apparatus and the fixing apparatus used in the fifth embodiment are the same as the first to fourth embodiments.

The control in the fourth embodiment will be explained with reference to a flow chart shown in FIG. 7.

First of all, in a starting condition (S81), the fixing apparatus 11 is in a waiting condition. In this condition, when the operator desires the cleaning, the image forming apparatus is switched to the cleaning mode by a signal from an operation panel on the main body M or a host computer (not shown). When it is judged that the image forming apparatus is switched to the cleaning mode (S82), the rotation of the motor (drive source for the pressure roller 26) is started and the energization to the heater 20 is also started (S83).

When it is judged that the temperature T of the surface of the pressure roller is higher than the softening point (softening temperature) $T_1$ of the toner (or reaches the temperature $T_1$ until the cleaning sheet reaches the nip N) (S84=Yes), the sheet supply is started (S85). It is judged whether the trail end of the cleaning sheet enters into the nip N (S86). If Yes, the heater is turned OFF (S87).

Then, when it is judged that the sheet discharge is finished (S88), the motor is stopped (S89), and the cleaning operation is finished (S90).

<Embodying Example 1>

Explanation is effected regarding an image forming apparatus in which the conveying speed of the sheet is selected to 50 mm/sec, the diameter of the pressure roller is selected to 25 mm, the rubber thickness of the mold releasing layer 26*b* of the pressure roller is selected to 3 mm, the nip width is selected to 5 mm, and a distance from the top sensor to the center of the nip is selected to 150 mm.

During the normal printing operation, the temperature of the heater 20 is controlled to maintain 150° C. to 190° C. The reason is that the heat is uniformly supplied to the sheet by controlling the heater 20 to the high temperature condition regarding the condition that the pressure roller 26 is cooled and to the low temperature condition regarding the condition that the pressure roller 26 is warmed.

Figure 7:
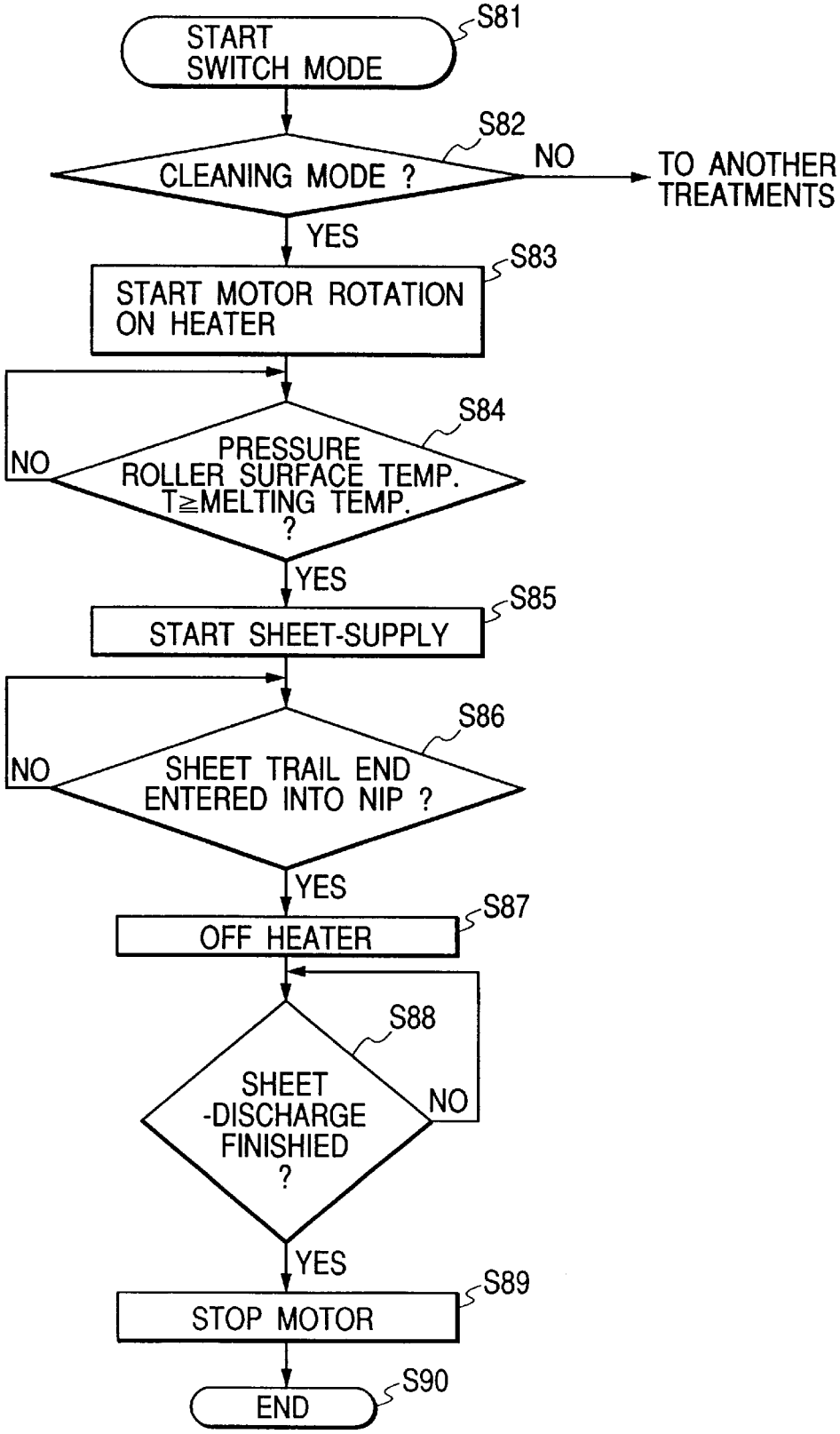
FIG. 7 is a flow chart for explaining a cleaning operation according to a fifth embodiment of the present invention.

Explaining with reference to the flow chart shown in FIG. 7, when the cleaning mode is started (S81), the rotation of the motor is started while controlling the temperature of the heater 20 to 190° C. to rotate the pressure roller 26 for 20 seconds (S83). As a result, the surface of the pressure roller is heated up to about 110° C. (softening temperature $T_1$ of the toner), thereby softening the toner on the surface of the pressure roller.

In this example, in place of the fact that the temperature of the surface of the pressure roller is directly measured, the heating time period is measured. When it is judged that the temperature T of the surface of the pressure roller reaches a temperature $T_1$ capable of softening the adhered matters sufficiently (S84), the sheet supply is started (S85) to transfer the adhered matters onto the sheet. Normally, since the surface of the pressure roller has a mold releasing ability greater than that of the surface of the paper sheet, the softened toner can easily be transferred onto the paper sheet, thereby removing the toner from the roller.

When it is judged that the trail end of the cleaning sheet P enters into the nip (S86), the heater is turned OFF (S87), and the sheet discharge is effected, and then, the cleaning mode is finished (S88 to S90).

As mentioned above, in the fifth embodiment, unlike to the conventional cleaning methods, since the sheet supply is started after the surface of the pressure roller was heated above the softening point of the toner, the toner adhered to the surface of the pressure roller can surely be removed. Since it is not required that the solid black image is formed on the cleaning paper sheet, even if the target temperature $T_1$ is exceeded, the adhering force acting between the cleaning paper sheet P and the pressure roller 26 does not become too great, with the result that the paper sheet P is not wound around the pressure roller 26.

Incidentally, in the fifth embodiment, the step-by-step feeding process may not be adopted as the first to fourth embodiments. When the step-by-step feeding process is adopted, the same effect as the first to fourth embodiments can be obtained.

<Sixth Embodiment>

In a sixth embodiment of the present invention, the fifth embodiment is improved to further enhance the cleaning ability. A difference from the fifth embodiment is that the control temperature of the heater is increased after the tip end of the sheet goes out the nip N. The toner, and a dimensional relation of the image forming apparatus and the fixing apparatus used in the sixth embodiment are the same as the fifth embodiment.

Figure 8:
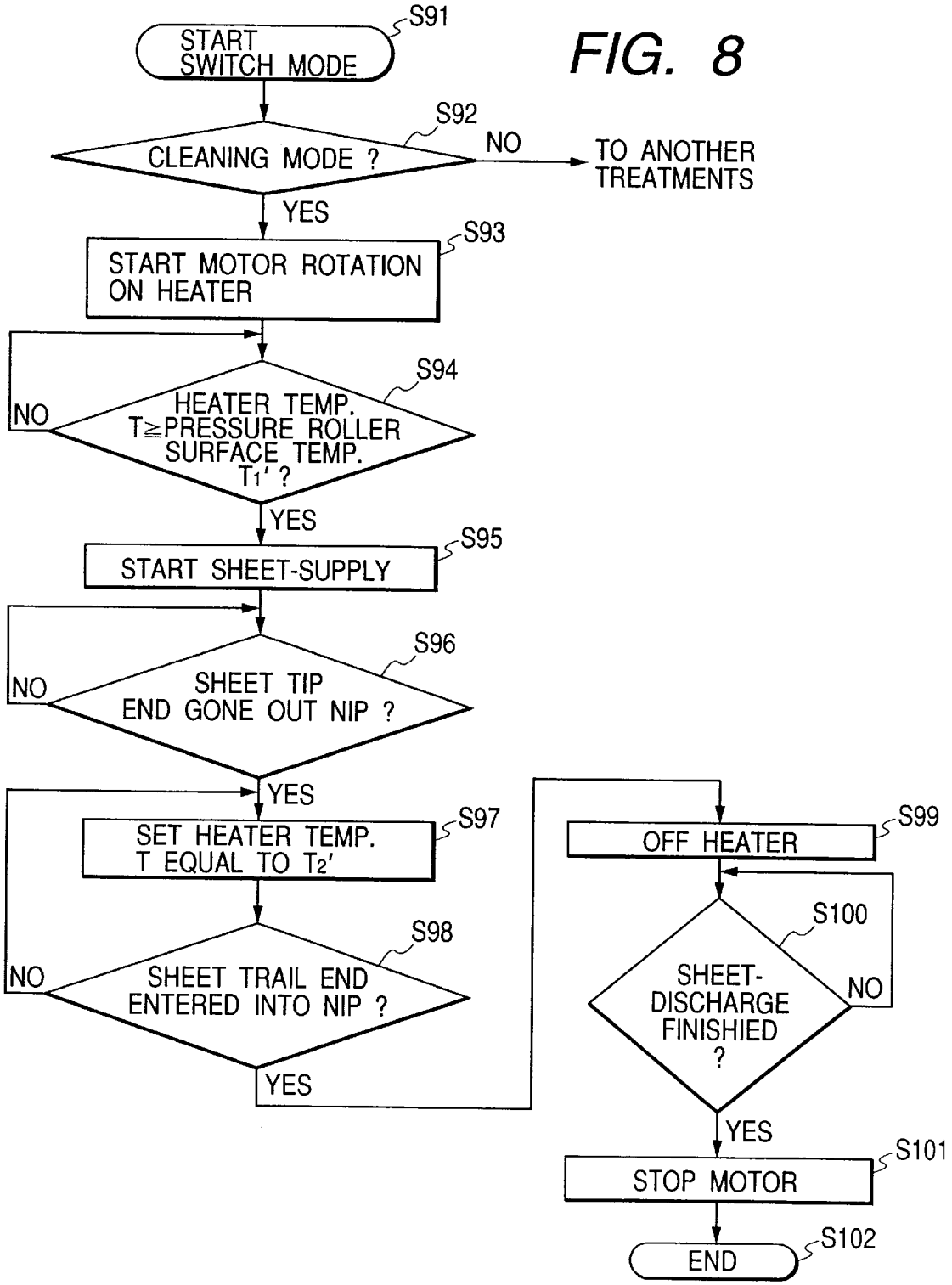
FIG. 8 is a flow chart for explaining a cleaning operation according to a sixth embodiment of the present invention.

The control in the sixth embodiment will be explained with reference to a flow chart shown in FIG. 8.

In the sixth embodiment, when the sheet P enters into the nip N, the temperature of the surface of the pressure roller is prevented from being decreased by an amount corresponding to the heat amount of the sheet, thereby improving the cleaning ability. Incidentally, since steps S91 to S93 and steps S98 to S102 of the cleaning operation shown in FIG. 8 correspond to the steps S81 to S84 and the step S86 to S90 in the fifth embodiment, explanation thereof will be omitted.

When it is judged as T (temperature of the heater) $\geqq T_1'$ or it is judged that the temperature T of the surface of the pressure roller exceeds the temperature $T_1'$ (S94=Yes), the sheet supply is started (S95).

When the tip end of the cleaning sheet goes out the nip N, judgement in a step S96 becomes "Yes", and, in this case, the temperature T of the heater is set to $T_2'$ ($T_2'>T_1'$) (S97). The temperature $T_2'$ is a temperature required for maintaining the temperature of the surface of the pressure roller above $T_1$ even the heat amount of the paper sheet P is added. The temperature $T_1$ is preferably greater than the softening point of the toner.

Incidentally, in the step S96 of the cleaning mode according to the sixth embodiment, while an example that the heat generating amount of the heater 20 per unit time is great was explained, the present invention is not limited to such an example, but, the surface temperature T of the pressure roller may be set to the target temperature $T_1'$ by changing the speed of the pressure roller 26 and pressure of the nip N (heating nip pressure).

<Embodying Example 1>

When the cleaning mode is started, the temperature T of the heater is temperature-controlled to achieve $T_1'$=190° C., and the pressure roller 26 is rotated for 20 seconds. Thereafter, the sheet is supplied. After the sheet P enters into the nip N, when the tip end of the sheet goes out the nip N, the temperature T of the heater is controlled to achieve $T_2'$=200° C.

When the trail end of the sheet P goes out the nip N, the energization to the heater 20 is turned OFF, and the sheet is discharged, and then the cleaning mode is finished.

According to the sixth embodiment, since the temperature of the surface of the pressure roller is not decreased even when the sheet P is pinched by the nip N, the toner contamination on the pressure roller can surely be cleaned. Consequently, the toner can be prevented from being accumulated again on the previous toner contamination.

<Embodying Example 2>

In an embodying example 2, the step S97 in the embodying example 1 is modified so that a time period for transferring the heat to the pressure roller 26 is lengthened by decreasing the speed of the motor while maintaining the temperature of the heater to $T_1'$, thereby compensating the heat amount absorbed by the sheet P. The same effect as the embodying example 1 can be expected.

As a method for decreasing the speed of the motor, the rotational speed of the motor may be reduced to ½ or ⅓, or, as is in the first to fourth embodiment, the step-by-step feeding process may be used. Further, the speed of the motor itself may not be changed, but, the speed of the pressure roller 26 may be changed by using a uniform speed device and the like.

According to the embodying example 2, the good cleaning operation can be performed as is in the embodying example 1, and, since the temperature of the heater is not increased above the heater temperature maintained during the normal printing operation, service lives of a safety element (not shown) and the heater holder which are contacted with the heater are not shortened and such elements are not deteriorated. Incidentally, also in the sixth embodiment, when the step-by-step feeding process is adopted as is in the first to fourth embodiments, the same effect as the first to fourth embodiments can be obtained.

<Seventh Embodiment>

In a seventh embodiment of the present invention, the first to sixth embodiments are modified to reduce power consumption and to achieve the cleaning efficiently for a short time. A difference from the cleaning modes in the first to sixth embodiments is that the heat generating amount of the heater per unit time while the energization to the heater is being turned OFF is smaller before the sheet reaches the fixing nip than during the stoppage of the pressure roller.

The toner, image forming apparatus and fixing apparatus used in the seventh embodiment are the same as those in the previous embodiments, and the same or similar elements are designated by the same reference numerals. Since some of dimensional relations differ from those in the first to sixth embodiments, such difference will be described appropriately.

Figure 9:
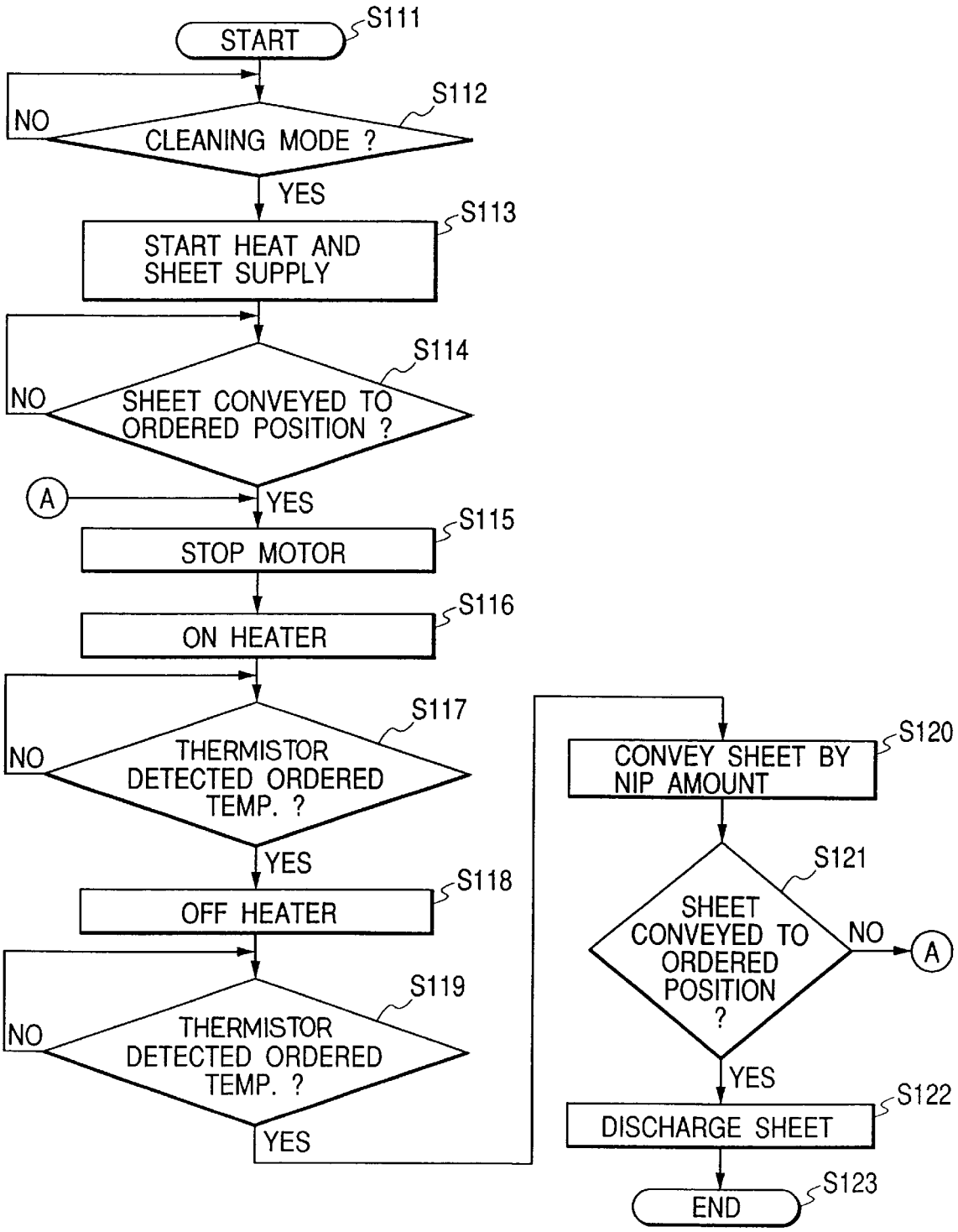
FIG. 9 is a flow chart for explaining a cleaning operation according to a seventh embodiment of the present invention.

Control in the seventh embodiment is shown in a flow chart of FIG. 9.

First of all, in a starting condition (Sill), the fixing apparatus 11 is in a waiting condition. In this condition, when the operator desires the cleaning of the pressure roller 26, the image forming apparatus is switched to the cleaning mode (S112) by a signal from the operation panel or the host computer.

In the cleaning mode of the image forming apparatus, in a step S113, a sheet from the sheet supply cassette (sheet supply portion) 7 starts to be supplied, and at the same time, the motor 29 is turned ON and the energization to the heater 20 is turned ON to start the heating. That is to say, the single paper sheet is sent from the sheet supply portion to the fixing apparatus without forming the image on the sheet while warming the pressure roller 26. The rotating pressure roller 26 is pre-heated by receiving the heat from the heater 20 through the fixing film 25 at the nip N. In this case, the heat generating amount of the heater 20 per unit time is controlled to a first predetermined level. Incidentally, the control temperature of the heater in the step S113 is preferably greater than the softening point of the toner, and is selected 180° C. in this seventh embodiment. The heater control temperature is preferably selected layer than the heater maximum temperature when the rotation of roller is stopped.

The sheet P supplied from the sheet supply portion 7 reaches the nip N. After the tip end of the sheet is pinched by the nip, when the tip end is conveyed up to a predetermined position after the tip end goes out the nip N (S114), the motor is stopped (S115), thereby stopping the conveyance of the sheet.

A time when the paper sheet supplied from the sheet supply portion reaches the nip N can be calculated on the basis of the conveying speed of the paper sheet and a time when the tip end passes through the top sensor 9, and, a time when the tip end of the sheet gone out the nip N is conveyed up to the predetermined position can also be calculated. Alternatively, the tip end of the paper sheet may be detected by a sensor disposed at a downstream side of the nip N. When it is judged that the tip end of the sheet is conveyed up to the predetermined position (S114=Yes), the motor is stopped (S115), thereby stopping the conveyance of the sheet. Incidentally, in the step S114, it may be judged whether the sheet is pinched between the pair of convey rollers.

Figure 10:
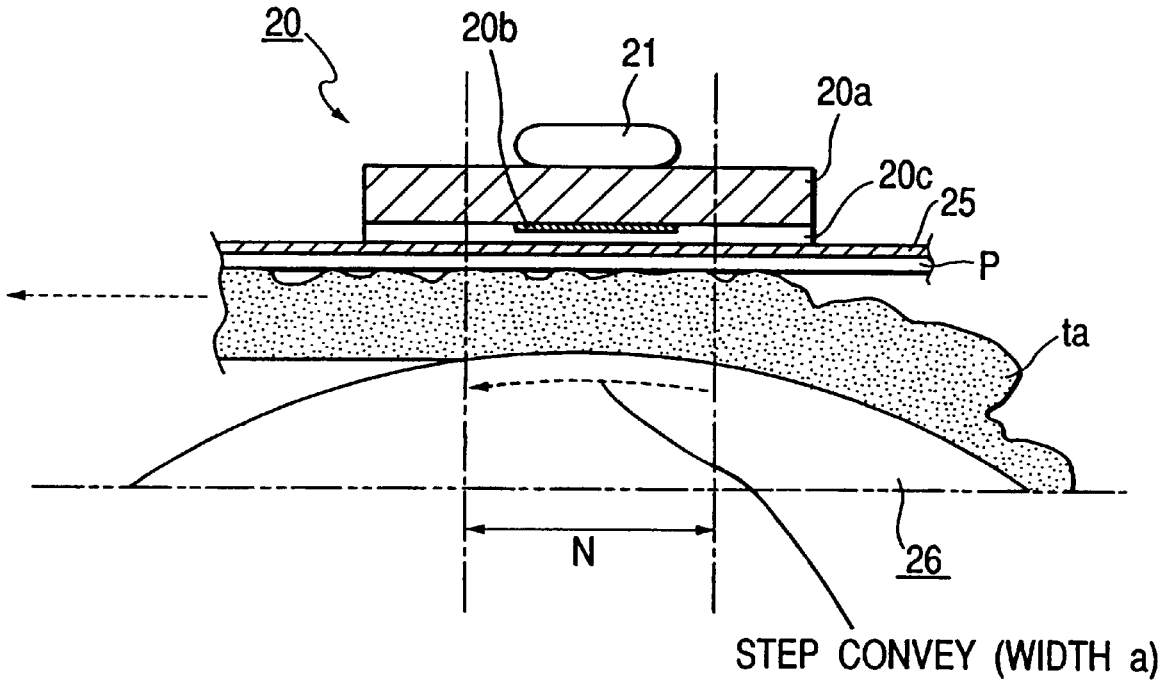
FIG. 10 is an enlarged schematic view of a nip for explaining the seventh embodiment.

Heater ON in a step S116 serves to cause the heater to further generate the heat more than the case of the step S113, i.e., to change the-heat generating amount of the heater 20 per unit time to a second predetermined lever greater than the first predetermined lever. As a result, at the nip N, the adhered matters (toner contamination ta; FIG. 10) on the surface of the pressure roller, and the pressure roller 26 start to be heated.

Figure 11:
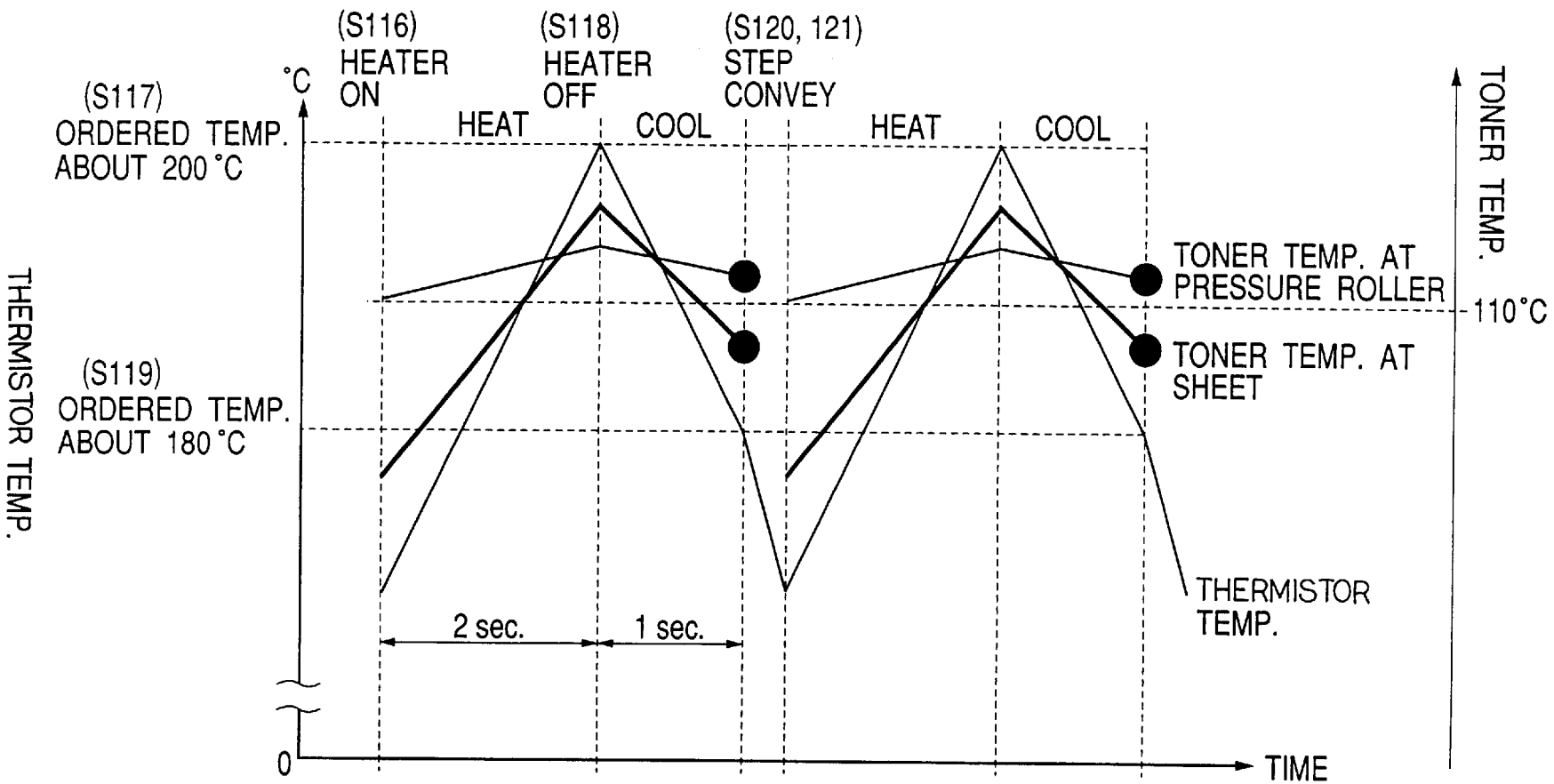
FIG. 11 is a view showing temperature transition of the nip according to the seventh embodiment.

FIG. 11 shows temperature transitions of the thermistor, pressure roller side and paper sheet side when the pressure roller is cleaned by using a fixing apparatus including a pressure roller having an outer diameter of 20 mm (aluminium core having a diameter of 13 mm) and a heater having electric power of about 400 W and providing a nip having a width of about 4.5 mm.

FIG. 10 is a schematic enlarged view of the nip.

In the cleaning mode, when the motor is stopped (S115), since the pressure roller 26 is warmed, the portion of the toner contacted with the pressure roller 26 is softened. However, since the surface of the toner ta contacted with air is cooled more than the pressure roller side and since the supplied sheet P has substantially a room temperature, the heat of the surface of the toner ta at the sheet side is further absorbed by the paper sheet to be cooled.

The heater is turned ON to increase the heat generating amount per unit time (S116), and the heating is continued until the designated heating temperature of about 200° C. is detected by the thermistor (S117). In this case, the toner at the sheet side is completely fused to penetrate into the paper and adhere thereto, but, the heat of the toner at the pressure roller side is absorbed by the pressure roller 26, so that the temperature of the toner at the pressure roller side is not so increased (refer to FIG. 11).

When the designated heating temperature of about 200° C. is detected by the thermistor (S117), the energization to the heater 20 is turned OFF (S118). The temperature of the heater is decreased by turning the heater OFF, thereby cooling the nip N. In this case, as shown in FIG. 11, since the heat capacity of the fixing film 25/paper sheet P is small, the toner at the sheet side is cooled quickly to be adhered to the paper sheet. However, the toner at the pressure roller side where the heat capacity is great is in the softened condition.

When the designated cooling temperature of about 180° C. is detected by the thermistor (S119), the motor is driven to convey the sheet P by an amount corresponding to the nip width a (S120). Incidentally, as the designated cooling temperature, the sheet side toner temperature is preferably smaller than the softening point of the toner.

By conveying the sheet by the amount corresponding to the nip width a, the toner ta on a surface portion of the pressure roller corresponding to the nip N is transferred onto a surface portion of the sheet corresponding to the surface portion of the pressure roller, thereby peeling and removing such toner from the surface portion of the pressure roller.

The above steps S115 to S120 are repeated until the sheet P has been conveyed to the designated position predetermined length conveyance). Due to this repetition, the toner ta on the surface of the pressure roller is successively adhered to the sheet by an amount corresponding to the nip width, thereby peeling and removing such toner from the surface portion of the pressure roller. Ultimately, the entire surface of the pressure roller is cleaned.

When the sheet P is conveyed to the designated position by repeating the above steps S115 to S120 (S121), the motor is driven at the normal constant speed, thereby discharging the sheet used for the cleaning of the pressure roller 26 from the fixing apparatus 11 (S122). When it is judged that the sheet discharge is completed, the cleaning mode for the pressure roller is finished (S123).

Since the heat capacity of the pressure roller 26 is great, the pressure roller can accumulate a large amount of heat by the pre-heating until the sheet P enters into the nip N. On the other hand, since the supplied sheet P has always substantially room temperature and good response ability, as shown in FIG. 11, the sheet can be heated and cooled up to the temperature determined by the thermistor 21 on the heater. For this reason, the toner at the sheet side can be adhered to the sheet while maintaining the toner at the pressure roller 26 side to the softened condition.

Of course, the thermistor designated temperatures in the steps S117 and S119 are varied with the heat capacity of the fixing apparatus 11, electric power of the heater, softening point of the toner and the like.

As is in the step S113, by turning the heater ON simultaneously with the sheet supply, the sliding torque of the fixing film 25 can be reduced. This utilizes the principle that the viscosity of grease coated on the inner surface of the fixing film 25 is decreased by increasing the temperature. Further, by pre-heating the pressure roller 26 having great heat capacity, the core of the pressure roller can be warmed.

Further, by decreasing the heat generating amount of the heater per unit time in the step S113 less than the heat generating amount of the heater per unit time in the step S117, the power consumption for the pre-heating can be suppressed, thereby saving the power and effecting the cleaning efficiently for a short time.

<Eighth Embodiment>

An eighth embodiment of the present invention improves the seventh embodiment so that uneven toner contamination can be cleaned efficiently. A difference from the seventh embodiment is that a width of the step-by-step feeding is smaller than ½ of the nip width. The toner, image forming apparatus and fixing apparatus used in the eighth embodiment are the same as those in the seventh embodiment.

Figure 12:
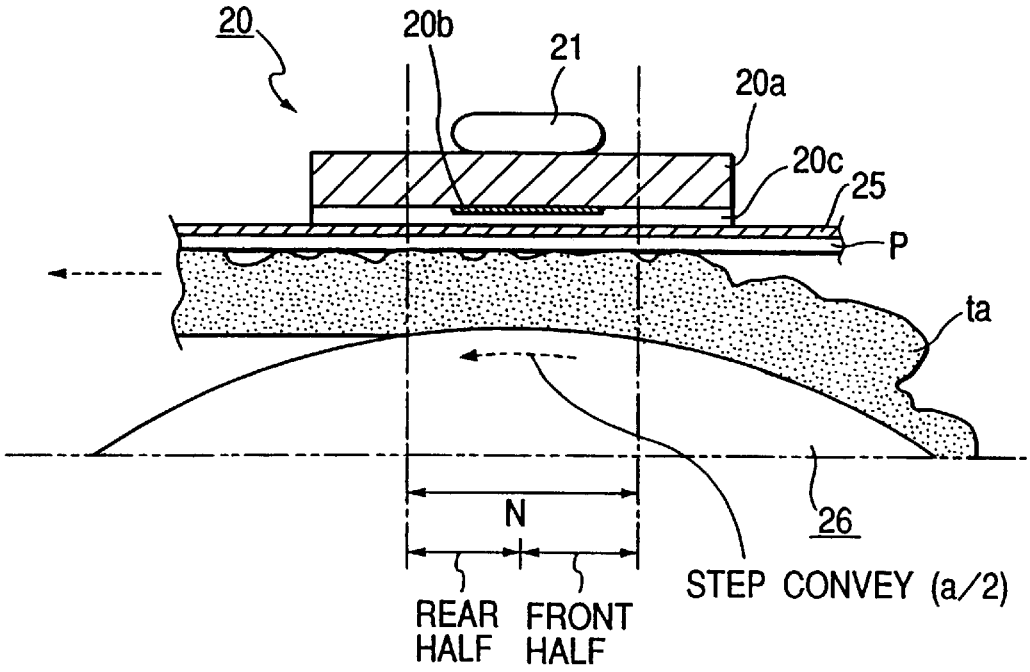
FIG. 12 is an enlarged schematic view of a nip for explaining an eighth embodiment of the present invention.

FIG. 12 is a schematic enlarged view of the nip. As shown, density of toner contamination ta adhered to the pressure roller 26 is not uniform but uneven, and, in some cases, the density of toner contamination ta is changed within the nip N as shown in FIG. 12.

In this condition, when the toner is discharged, although almost all of toner ta can be cleaned, since the adhering force between the toner and the paper sheet P is weak at the toner portion having low density, it fears that the toner is still adhered to the pressure roller 26 and is not removed.

To avoid this, in the eighth embodiment, the width of the step-by-step feeding is selected to become smaller than ½ of the nip width. By doing so, after the density of the toner at a front half part of the nip is made substantially uniform by the heating, such toner is shifted to a rear half part of the nip. And, by re-heating such toner at the rear half part of the nip, the adhered matters at the sheet-side penetrate into the sheet P to be adhered thereto strongly.

In this way, in the cleaning mode according to the eighth embodiment, even if the toner contamination on the pressure roller is uneven, the cleaning can be effected efficiently.

Incidentally, in the cleaning modes according to the fifth to eighth embodiments, while an example that the white paper sheet on which the image was not formed is sent to the fixing apparatus was explained, as is in the first to fourth embodiments, in place of the white paper sheet, a sheet on which the word "cleaning was completed" (message to the operator) was formed may be sent to the fixing apparatus.

Further, dimensions, temperatures and times (time periods) used for explanation of the first to eight embodiments are merely examples, and, in actual, such values are independently determined in dependence upon the construction of the image forming apparatus, the nature of the toner and the like.

In addition, the amount of the step-by-step feeding effected by the motor 20 does not always correspond to the nip width a, but, there is no problem so long as the entire peripheral surface of the pressure roller 26 can be cleaned thoroughly by rotating the pressure roller 26 by several revolutions.

Figure 14:
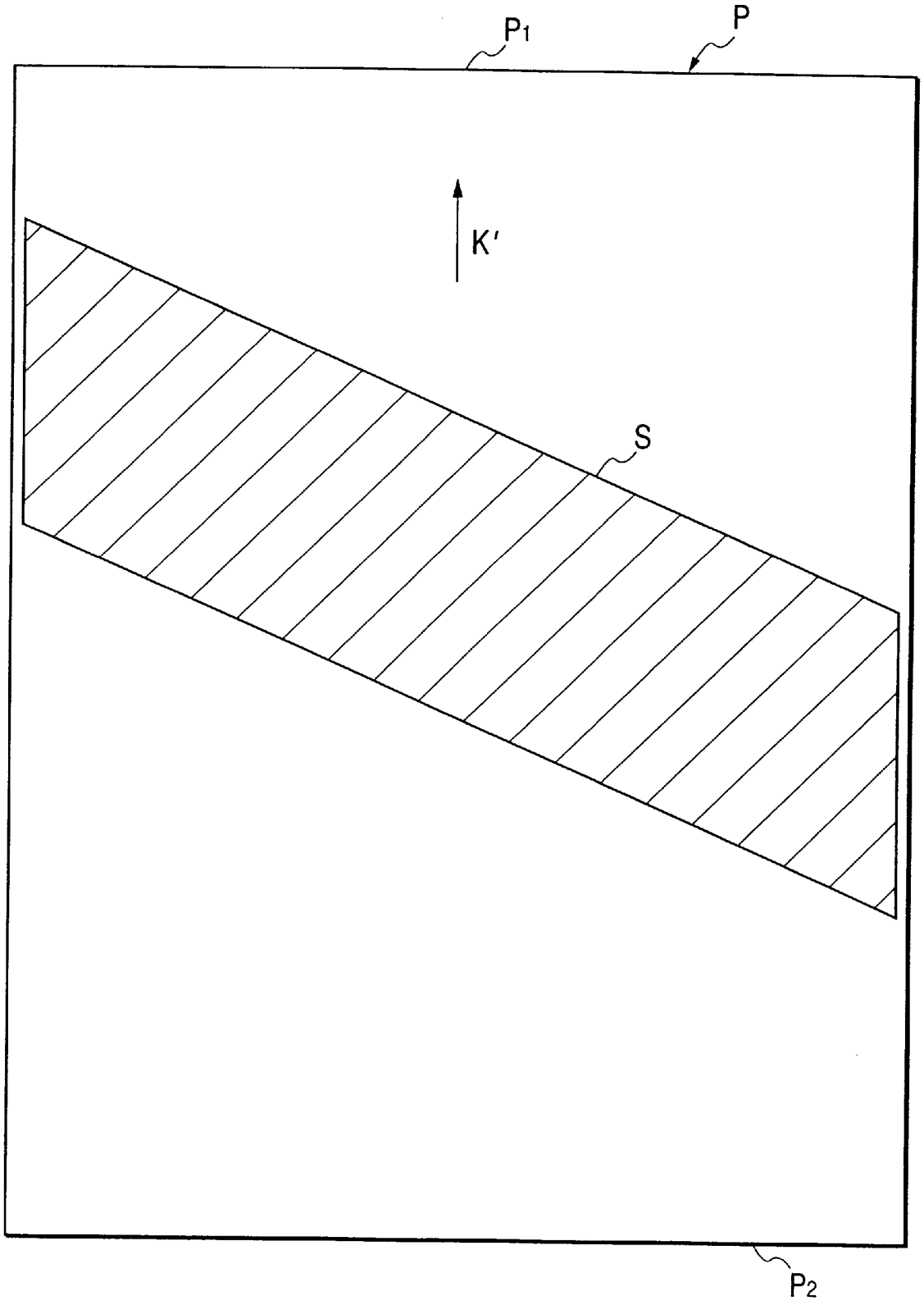
FIG. 14 is a view showing a recording pattern of a sheet used for cleaning.

In the above-mentioned embodiments, since the cleaning is effected by using the white paper sheet, it is not required that the front/rear surface of the cleaning sheet is ascertained, and, thus, the cleaning operation can be facilitated. Further, in order to eliminate the troublesome cleaning, while an example that the single sheet is used for effecting the cleaning was explained, the cleaning may be effected by using several paper sheets. In addition, in order to obtain further excellent cleaning effect, for example, as shown in FIG. 14, an oblique black strip may be printed on a sheet P having a tip end P1 and a trail end P2, and the cleaning mode may be carried out while sending the sheet to the nip N of the fixing apparatus 11 toward a direction shown by the arrow K' in a condition that the printed surface is to be faced to the pressure roller 26.

Further, in order to enhance the cleaning effect, it is preferable that the surface layer of the pressure roller 26 is constituted as a resin coat layer made of PFA, PTFE, FEP or the like having good mold releasing ability or is coated by a tube made of similar resin.

Furthermore, the fact that the cleaning is being effected may be indicated to the operator by operating the laser optical system during the cleaning operation.

This provides an advantage that the operator is prevented from carrying out unwanted manipulation during the cleaning operation.

Figure 15:
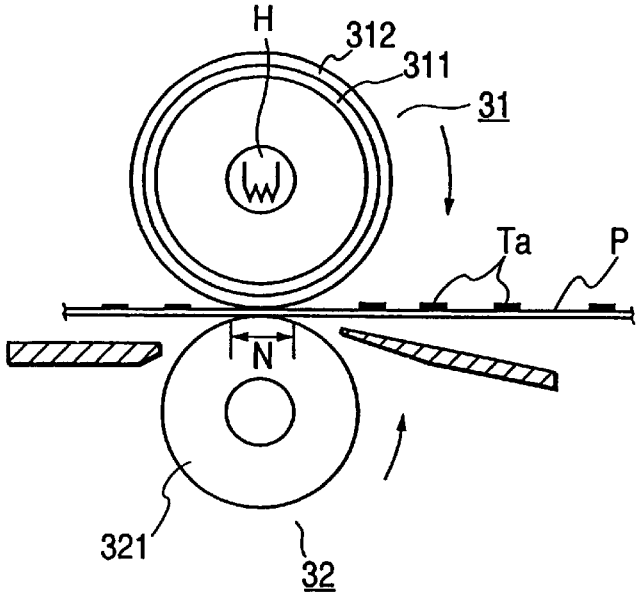
FIG. 15 is a schematic sectional view showing another fixing apparatus according to the present invention.

In the first to eight embodiments, while an example that the fixing apparatus 11 having the fixing film 25 is used was explained, the present invention is not limited to such an example, but, the present invention can be applied to conventional fixing apparatuses in which combination of a fixing roller 31 and a pressure roller 32 is used as shown in FIG. 15.

The pressure roller 32 is a fixing rotary member having a silicone rubber surface layer 321, and the fixing roller 31 is a fixing rotary member having a core 311 and a mold releasing surface layer 312 made of fluororesin. A heat source such as a halogen heater $H_t$ is incorporated into the fixing roller.

The present invention providing the same cleaning effect regarding the fixing film 25 cooperating with the pressure roller to form the nip N therebetween and the fixing roller, as is in the pressure roller. That is to say, the present invention is effective to any fixing rotary members such as the fixing film 25, fixing roller and the like as well as the pressure roller. Incidentally, so long as one of the elements forming the nip N is a fixing rotary member, the other is not limited to a fixing rotary member but may be a fixed abut member. Also with such an arrangement, the toner adhered to the surface of the fixing rotary member urged against the abut member can be removed effectively.

For example, an apparatus of electromagnetic heating type in which dielectric current is generated by acting a magnetic force on a conductive and ferromagnetic member thereby to generate heat by said member may be used.

Figure 16A:
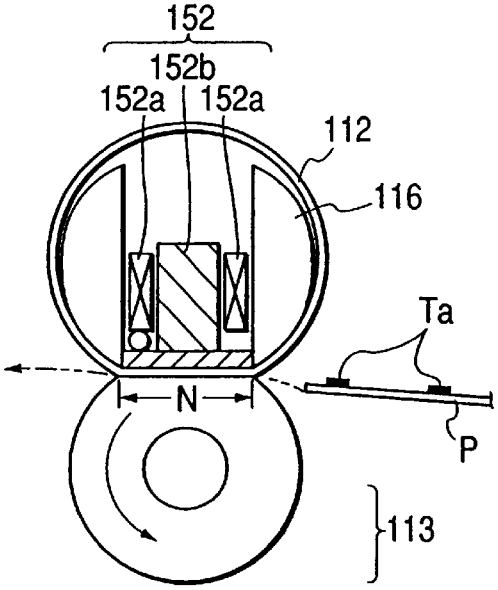
FIGS. 16A, 16B and 16C are schematic sectional views showing a further fixing apparatus according to the present invention.

FIG. 16A is a schematic view of such a heating apparatus of electromagnetic heating type, in which a film inner surface guide stay 116 having a substantially U-shaped cross-section is formed from liquid crystal polymer/phenol resin, and, within the guide stay, there is provided an excitation coil 152 constituted by winding windings 152*b* around a core member (iron core) 152*a*.

A cylindrical fixing film (heating body) 112 is loosely mounted around an assembly of the stay 116 and the excitation coil 152, and a pressure roller 113 is urged against the assembly with the interposition of the film 112.

Figure 16C:
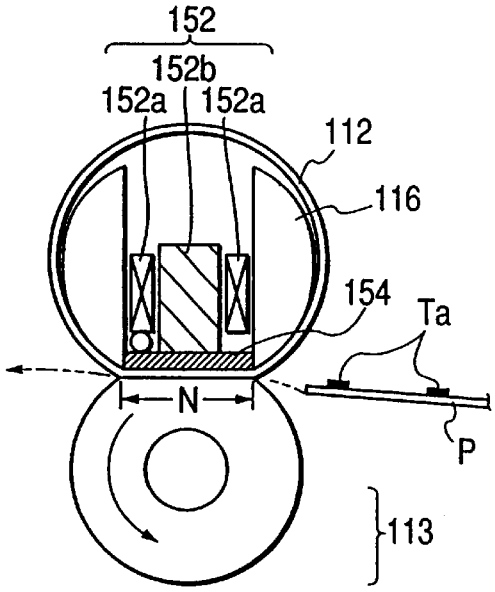
Figure 16B:
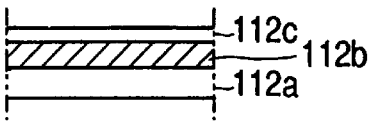

As shown in FIG. 16B, the film 112 has a three-layer structure including a substrate layer (endless film) 112*a* made of heat-resistive resin such as polyimide, polyamideimide, PEEK, PES, PTFE or FEP, a conductive layer 112*b* coated on an outer surface of the substrate layer 112*a* and formed from a metallic layer such as iron, cobalt, nickel, copper or chrome, and a mold releasing layer 112*c* coated on an outer surface of the conductive layer 112*b* and made of heat-resistive resin having good toner mold releasing ability such as PTF, PTFE, FEP or combination thereof. In this example, while the film substrate layer 112*a* and the conductive layer 112*b* were separate layers, a film substrate layer itself may be a conductive layer.

In a condition that the film is rotated by rotation of the pressure roller 113 and the conductive layer 112*b* of the film 112 generates heat due to electromagnetic induction generated by applying voltage from an excitation circuit to the excitation coil 152, a sheet P (to be heated) is introduced into the nip N. While the sheet is being passed through the nip N together with the film 112 in a condition that the sheet is closely contacted with the lower surface of the film, the heat of the film 112 is given to the recording sheet P, thereby fixing a non-fixed toner image Ta onto the sheet.

As another heating apparatus of electromagnetic heating type, as shown in FIG. 16C, a heating apparatus in which a heating body 154 as a flat plate-shaped conductive member (made of ferromagnetic metal or the like) is heated by magnetic flux from an excitation coil 152 and a pressure member 113 urged against the heating body 154 with the interposition of a film 112 to form a nip N therebetween is rotated so that a sheet P introduced into the nip N is subjected to heat treatment while the sheet is being conveyed through the nip may be used.

Figure 17A:
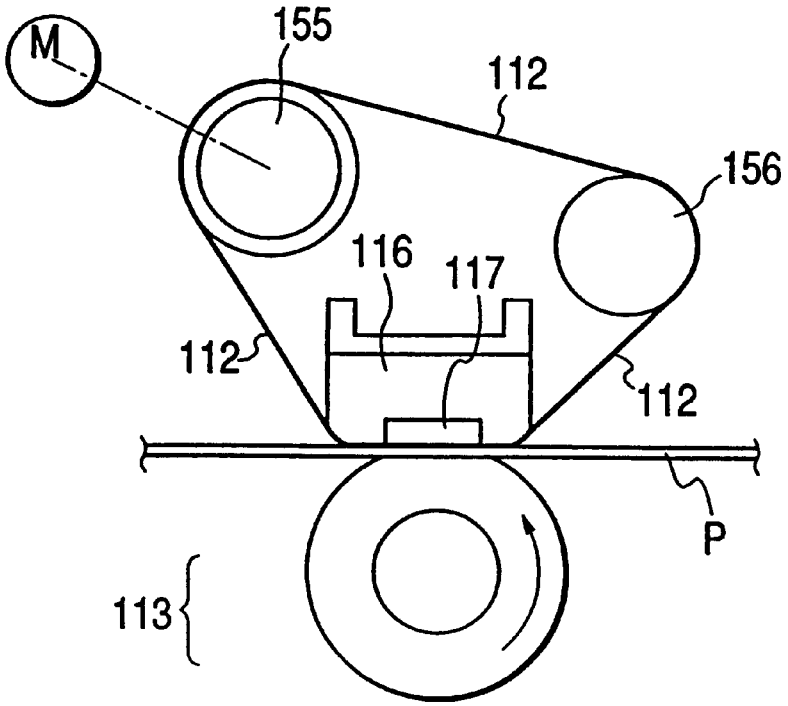
FIGS. 17A and 17B are schematic sectional views showing a still further fixing apparatus according to the present invention.
Figure 17B:
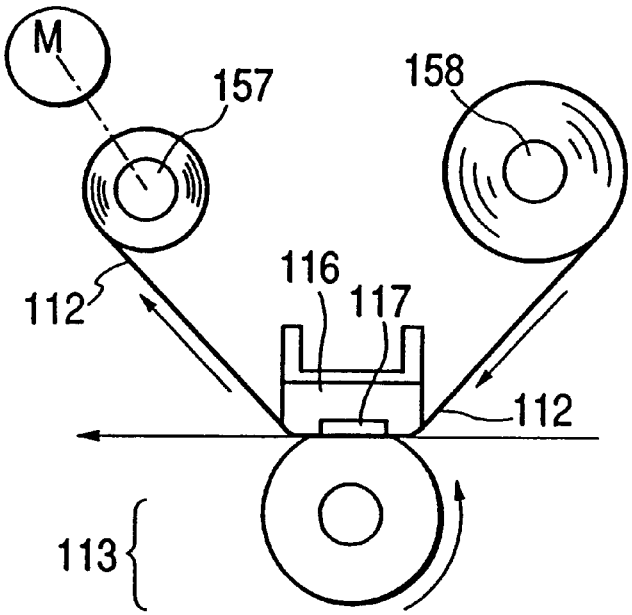

Alternatively, the following apparatuses in which a means for driving the film differs from that in the above-mentioned embodiments may be used. FIGS. 17A and 17B are schematic views showing these apparatuses, respectively.

In the apparatus shown in FIG. 17A, an endless fixing film 112 is mounted and wound around a heater (heat generating body) 117, a drive roller 155 and a tension roller 156, and the drive roller 155 is driven by a fixing drive means M to rotate the fixing film 112. Incidentally, a pressure roller 113 is rotatingly driven by rotation of the fixing film 112.

In the apparatus shown in FIG. 17B, an elongated non-endless film is used as a fixing film 112, and the film is shifted from a supply shaft 158 to a take-up shaft 157 through a heater 117 at a predetermined speed.

In the apparatuses shown in FIGS. 16A to 16C and 17A and 17B, when the pressure roller 113 is a driven roller, by changing a rotational speed of the fixing film 112, drive roller 155 or take-up shaft 157, or by effecting the step-by-step feeding regarding these rollers to change the conveying speed of the sheet P (i.e., speed of the pressure roller 113), the same effect as the first to eighth embodiments can be achieved.

Further, in the above-mentioned embodiments, while an example that the energization to the heater 20 is turned ON or OFF during the stoppage of the sheet was explained, in place of energization OFF, the heat generating amount of the heater 20 per unit time may be decreased. That is to say, by decreasing the heat generating amount of the heater 20 per unit time, the heating amount for heating the adhered matters is reduced, thereby softened adhered matters may be solidified.

Furthermore, in the second to fourth embodiments, while an example that the temperature of the heater is controlled by the timer was explained, a detect means for detecting the temperature of the surface of the pressure roller may be provided so that the temperature of the heater is controlled on the basis of the detected temperature of the surface of the pressure roller. That is to say, when the temperature of the surface of the pressure roller reaches a predetermined temperature higher than the softening point of the toner, the energization to the heater is turned OFF; whereas, when the temperature of the surface of the pressure roller becomes a predetermined temperature lower than the softening point of the toner, the sheet is conveyed by an amount corresponding to the nip width.

Further, in the first to fourth embodiments, while an example that when the operator desires the cleaning operation the cleaning operation is effected was explained, whenever the predetermined number of recording sheets are image-fixed, the cleaning mode may automatically be effected.

Further, in recent years, although mixture of toner and $CaCO_3$ included in the paper sheet or paper powder is adhered to the fixing rotary member such as the pressure roller to worsen the mold releasing ability of the roller, the present invention is effective to remove the mixture of toner and $CaCO_3$ or paper powder. That is to say, the present invention can provide an image forming apparatus which can prevent sheet jam and image contamination for a long term.

Further, the heating amount may be changed so that softening and solidifying of the adhered matters are repeated by several times during the stoppage of the sheet conveyance.

Incidentally, the present invention may be applied as a part of a system comprising a plurality of equipments (for example, a host computer, interface equipments, a reader, a printer and the like), or a part of an apparatus including a single equipment (for example, a copying machine, a facsimile or the like).

Further, the present invention is not limited to an apparatus and a method for implementing the above-mentioned embodiments, but, the present invention includes or covers a technique in which software program code for implementing the above-mentioned embodiments is supplied to a computer (CPU or MPU) in the above-mentioned system or apparatus and the above-mentioned embodiments can be implemented by operating various devices by means of the computer in the above-mentioned system or apparatus on the basis of the program code.

In this case, the software program code itself implements the functions of the above-mentioned embodiments, and, the present invention includes the program code itself, and a means for supplying the program code to the computer (more specifically, a storage medium for storing the program code).

As the storage medium for storing such program code, for example, a floppy disc, a hard disc, an optical disc, a photo-magnetic disc, a CD-ROM, a magnetic tape, a non-volatile memory card, a ROM and the like may be used.

Further, not only when the functions of the above-mentioned embodiments are implemented by controlling the various devices by means of the computer only in accordance with the program code supplied, but also when the program code cooperates with OS (operating system) operating on the computer or other application software to implement the above-mentioned embodiments, such a program code is included in the present invention.

In addition, after the supplied program code is stored in a memory provided in a function expansion board or in a function expansion unit connected to the computer, when a CPU and the like provided in the function expansion board or the function expansion unit executes part or all of the actual processing on the basis of the instruction of the program code, thereby implementing the above-mentioned embodiments, such a program code is included in the present invention.

What is claimed is:

1. A fixing apparatus comprising a pair of fixing members at least one of which is rotatable, a nip being formed between said fixing members, and a recording material which carries a non-fixed toner being conveyed through said nip and heated at said nip to fix the non-fixed toner onto the recording material;

wherein said apparatus has a cleaning mode for cleaning said rotatable fixing member, in which a sheet is pinched by said nip, and the sheet is conveyed in one direction by repeating rotation and stoppage of said rotatable fixing member.

2. A fixing apparatus according to claim 1, wherein, in said cleaning mode, a temperature of a surface of said rotatable fixing member now stopped is greater than a softening point of toner.

3. A fixing apparatus according to claim 1, wherein, in said cleaning mode, an entire peripheral surface of said rotatable fixing member is contacted with said sheet by at least one time in a stopped condition.

4. A fixing apparatus according to claim 1, wherein, in said cleaning mode, a temperature of a surface of said rotatable fixing member before firstly stopped is greater than a softening point of toner.

5. A fixing apparatus according to claim 1, further comprising a pair of convey members urged against each other and disposed at a downstream side of said nip in a sheet conveying direction, and wherein, in said cleaning mode, after a tip end of said sheet enters into said nip, said rotatable fixing member is not stopped until the tip end of said sheet enters into an abut portion between said convey members.

6. A fixing apparatus according to claim 1, wherein, in said cleaning mode, after said rotatable fixing member is stopped, when a predetermined time period is elapsed, said rotatable fixing member starts to rotate.

7. A fixing apparatus according to claim 1, further comprising a heating means, and wherein, in said cleaning mode, said heating means heats said rotatable fixing member while said rotatable fixing member is stopped.

8. A fixing apparatus according to claim 7, wherein, in said cleaning mode, a heating amount of said heating means for heating said rotatable fixing member now stopped has a first heating amount until an entire peripheral surface of said rotatable fixing member is contacted with said sheet by at least one time in a stopped condition and a second heating amount greater than said first heat amount after the entire peripheral surface of said rotatable fixing member is contacted with said sheet by at least one time in the stopped condition.

9. A fixing apparatus according to claim 8, wherein said heating amount is a heat generating amount per unit time.

10. A fixing apparatus according to claim 8, wherein a temperature of a surface of said rotatable fixing member heated with said first heating amount becomes greater than a softening point of toner.

11. A fixing apparatus according to claim 7, wherein heating means heats at least a portion of said rotatable fixing member which forms said nip.

12. A fixing apparatus according to claim 1, further comprising a heating means, and wherein, in said cleaning mode, said heating means heats said rotatable fixing member with a first heating amount while said rotatable fixing member is stopped and then heats said rotatable fixing member with a second heating amount smaller than said first heating amount, and said rotatable fixing member starts to rotate while said heating means is effecting the heating with said second heating amount.

13. A fixing apparatus according to claim 12, wherein said first heating amount and said second heating amount are each a heat generating amount per unit time.

14. A fixing apparatus according to claim 12, wherein a temperature of a surface of said rotatable fixing member heated with said first heating amount becomes greater than a softening point of toner.

15. A fixing apparatus according to claim 12, wherein a temperature of a surface of said rotatable fixing member heated with said second heating amount becomes smaller than a softening point of toner.

16. A fixing apparatus according to claim 12, wherein, in said cleaning mode, a heating amount of said heating means before said rotatable fixing member is initially stopped is smaller than said first heating amount.

17. A fixing apparatus according to claim 12, wherein, in said cleaning mode, after an entire peripheral surface of said rotatable fixing member is contacted with said sheet by at least one time in a stopped condition, said heating means heats said rotatable fixing member now stopped with a third heating amount greater than said first heating amount and then heats said rotatable fixing member with said second heat amount, and said rotatable fixing member starts to rotate while said heating means is effecting the heating with said second heating amount.

18. A fixing apparatus according to claim 12, wherein, in said cleaning mode, when a predetermined time period is elapsed after said rotatable fixing member is stopped, a heating amount of said heating means is changed from said first heating amount to said second heating amount.

19. A fixing apparatus according to claim 12, further comprising a detect means for detecting a temperature of a surface of said rotatable fixing member, and wherein, in said cleaning mode, a heating amount of said heating means is changed from said first heating amount to said second heating amount in accordance with a detected result of said detect means.

20. A fixing apparatus according to claim 19, wherein, in said cleaning mode, when said detected result is a predetermined value smaller than a softening point of toner, the heating amount of said heating means is changed from said first heating amount to said second heating amount.

21. A fixing apparatus according to claim 12, wherein, in said cleaning mode, said rotatable fixing member starts to rotate when a predetermined time period is elapsed after a heating amount of said heating means is controlled to said second heating amount.

22. A fixing apparatus according to claim 12, further comprising a detect means for detecting a temperature of a surface of said rotatable fixing member, and wherein, in said cleaning mode, said rotatable fixing member starts to rotate in accordance with a detected result of said detect means.

23. A fixing apparatus according to claim 22, wherein, in said cleaning mode, when said detected result is a predetermined value smaller than a softening point of toner, said rotatable fixing member starts to rotate.

24. A fixing apparatus according to claim 1, further comprising a heating means for generating heat by energization, and wherein, in said cleaning mode, the energization to said heating means is changed from ON to OFF while said rotatable fixing member is stopped, and, when the energization to said heating means is ON, said rotatable fixing member starts to rotate.

25. A fixing apparatus according to claim 24, wherein, in said cleaning mode, a temperature of a surface of said rotatable fixing member when the energization to said heating means is ON becomes greater than a softening point of toner.

26. A fixing apparatus according to claim 24, wherein, in said cleaning mode, a heat generating amount of said heating means per unit time before said rotatable fixing member is initially stopped is smaller than a heat generating amount of said heating means per unit time while said rotatable fixing member is stopped.

27. A fixing apparatus according to claim 24, wherein, in said cleaning mode, a heat generating amount of said heating means per unit time when said rotatable fixing member is stopped and the energization to said heating means is ON is a first heat generating amount until an entire peripheral surface of said rotatable fixing member is contacted with said sheet in a stopped condition, and becomes a second heat generating amount greater than said first heat generating amount after the entire peripheral surface of said rotatable fixing member is contacted with said sheet by at least one time in the stopped condition.

28. A fixing apparatus according to claim 24, wherein, in said cleaning mode, when a predetermined time period is elapsed after said rotatable fixing member is stopped and the energization to said heating means is turned ON, the energization to said heating means is turned OFF.

29. A fixing apparatus according to claim 24, further comprising a detect means for detecting a temperature of a surface of said rotatable fixing member, and wherein, in said cleaning mode, the energization to said heating means is turned OFF in accordance with a detected result of said detect means.

30. A fixing apparatus according to claim 29, wherein, in said cleaning mode, when said detected result is a predetermined value smaller than a softening point of toner, the energization to said heating means is turned OFF.

31. A fixing apparatus according to claim 24, wherein, in said cleaning mode, when a predetermined time period is elapsed after the energization to said heating means is turned OFF, said rotatable fixing member starts to rotate.

32. A fixing apparatus according to claim 24, further comprising a detect means for detecting a temperature of a surface of said rotatable fixing member, and wherein, in said cleaning mode, said rotatable fixing member starts to rotate in accordance with a detected result of said detect means.

33. A fixing apparatus according to claim 32, wherein, in said cleaning mode, when said detected result is a predetermined value smaller than a softening point of toner, said rotatable fixing member starts to rotate.

34. A fixing apparatus according to claim 1, wherein, in said cleaning mode, a length along which said sheet is conveyed from when said rotatable fixing member is stopped to when said rotatable fixing member is next stopped is greater than a length of said nip in a sheet conveying direction.

35. A fixing apparatus according to claim 1, wherein said sheet is a recording material which does not bear toner.

36. A fixing apparatus according to claim 1, wherein said sheet is a recording material on which fixed toner is born.

37. A fixing apparatus according to claim 1, wherein said pair of fixing members comprises a fixing roller and a pressure roller.

38. A fixing apparatus according to claim 1, wherein said pair of fixing members comprises an endless film and a pressure roller.

39. A fixing apparatus according to claim 1, wherein, among said pair of fixing members, the rotatable fixing member is a fixing member having silicone rubber as a surface layer, and the other is a fixing member having fluororesin as a surface layer.

40. A fixing apparatus according to claim 1, wherein said sheet is a paper.

41. A storage medium for storing, in a computer readable condition, a program, comprising:

a step for causing a sheet to be pinched by a nip between a pair of fixing members at least one of which is rotatable; and a step for conveying said sheet in one direction by repeating rotation and stoppage of said rotatable fixing member.

42. A storage medium according to claim 41, wherein said program further comprises a surface temperature control step for controlling a surface temperature of said rotatable fixing member in a stopped condition to be greater than a softening point of toner.

43. A storage medium according to claim 41, wherein said program further comprises a rotation start step for initiating rotation of said rotatable fixing member when a predetermined time period is elapsed after said rotatable fixing member is stopped.

44. A storage medium according to claim 41, wherein said program further comprises a stoppage/rotation repeating step for repeating stoppage and rotation of said rotatable fixing member until an entire peripheral surface of said rotatable fixing member is contacted with said sheet by at least one time in a stopped condition.

45. A storage medium according to claim 41, wherein said program further comprises a rotation control step for continuously rotating and not stopping said rotatable fixing member until a tip end of said sheet enters into an abut portion between a pair of convey members urged against each other and disposed at a downstream side of said rotatable fixing member in a sheet conveying direction.

46. A storage medium according to claim 41, wherein said program further comprises a surface temperature control step for controlling a surface temperature of said rotatable fixing member to be greater than a softening point of toner before said rotatable fixing member is initially stopped.

47. A storage medium according to claim 46, wherein said program further comprises a first heating step for heating said rotatable fixing member with a first heating amount before said rotatable fixing member is initially stopped, and a second heating step for heating said rotatable fixing member with a second heating amount greater than said first heating amount while said rotatable fixing member is stopped.

48. A storage medium according to claim 41, wherein said program further comprises a sheet conveying step for conveying said sheet by a length greater than a length of the nip between said fixing members from when said rotatable fixing member is stopped to when said rotatable fixing member is next stopped.

49. A storage medium according to claim 41, wherein said program further comprises a heating step for heating said rotatable fixing member now stopped.

50. A storage medium according to claim 49, wherein said program further comprises a first heating step for heating said rotatable fixing member with a first heating amount until an entire peripheral surface of said rotatable fixing member is contacted with said sheet by at least one time in a stopped condition, and a second heating step for heating said rotatable fixing member with a third heating amount greater than said first heating amount after the entire peripheral surface of said rotatable fixing member is contacted with said sheet by at least one time in the stopped condition.

51. A storage medium according to claim 41, wherein said program further comprises a heating step for heating said rotatable fixing member now stopped with a first heating amount and then heating said rotatable fixing member with a second heating amount greater than said first heating amount, and a rotation start step for initiating rotation of said rotatable fixing member while said rotatable fixing member is being heated with said second heating amount.

52. A storage medium according to claim 51, wherein said program further comprises a heating amount control step for controlling the heating amount from said first heating amount to said second heating amount when a predetermined time period is elapsed after said rotatable fixing member is stopped.

53. A storage medium according to claim 51, wherein said program further comprises a heating amount control step for controlling the heating amount from said first heating amount to said second heating amount in accordance with a detected result of a detect means for detecting a surface temperature of said rotatable fixing member.

54. A storage medium according to claim 53, wherein said program further comprises a heating amount control step for controlling the heating amount from said first heating amount to said second heating amount when said detected result becomes a predetermined value greater than a softening point of toner.

55. A storage medium according to claim 51, wherein said program further comprises a rotation start step for initiating rotation of said rotatable fixing member when a predetermined time period is elapsed after said rotatable fixing member is heated with said second heating amount.

56. A storage medium according to claim 51, wherein said program further comprises a rotation start step for initiating rotation of said rotatable fixing member in accordance with a detected result of a detect means for detecting a surface temperature of said rotatable fixing member.

57. A storage medium according to claim 56, wherein said program further comprises a rotation start step for initiating rotation of said rotatable fixing member when said detected result becomes a predetermined value smaller than a softening point of toner.

58. A storage medium according to claim 51, wherein said program further comprises a second heating step for heating said rotatable fixing member with a heating amount smaller than said first heating amount before said rotatable fixing member is initially stopped.

59. A storage medium according to claim 51, wherein said program further comprises a second heating step for heating said rotatable fixing member with a third heating amount greater than said first heating amount after an entire peripheral surface of said rotatable fixing member is contacted with said sheet by at least one time in a stopped condition, and a rotation start step for initiating rotation of said rotatable fixing member while said rotatable fixing member is being heated with said second heating amount.

60. A storage medium according to claim 41, wherein said program further comprises an energization OFF step for turning OFF energization to a heater for heating said rotatable fixing member, and a rotation start step for initiating rotation of said rotatable fixing member when the energization to said heater is turned OFF.

61. A storage medium according to claim 60, wherein said program further comprises an energization control step for turning OFF energization to said heater when a predetermined time period is elapsed after said rotatable fixing member is stopped.

62. A storage medium according to claim 60, wherein said program further comprises an energization control step for turning OFF energization to said heater in accordance with a detected result of a detect means for detecting a surface temperature of said rotatable fixing member.

63. A storage medium according to claim 62, wherein said program further comprises an energization control step for turning OFF energization to said heater when said detected result becomes a predetermined value greater than a softening point of toner.

64. A storage medium according to claim 60, wherein said program further comprises a rotation start step for initiating rotation of said rotatable fixing member when a predetermined time period is elapsed after the energization to said heater is turned OFF.

65. A storage medium according to claim 60, wherein said program further comprises a rotation start step for initiating rotation of said rotatable fixing member in accordance with a detected result of a detect means for detecting a surface temperature of said rotatable fixing member.

66. A storage medium according to claim 65, wherein said program further comprises a rotation start step for initiating rotation of said rotatable fixing member when said detected result becomes a predetermined value greater than a softening point of toner.

67. A storage medium according to claim 60, wherein said program further comprises a first heat generating amount control step for bringing a heat generating amount of said heater per unit time to a first heat generating amount before said rotatable fixing member is initially stopped, and a second heat generating amount control step for bringing a heat generating amount of said heater per unit time when said rotatable fixing member is heated and the energization to said heater is turned ON to a second heat generating amount greater than said first heat generating amount.

68. A storage medium according to claim 60, wherein said program further comprises a first heat generating amount control step for bringing a heat generating amount of said heater per unit time when the energization to said heater is turned ON to a first heat generating amount until an entire peripheral surface of said rotatable fixing member is contacted with said sheet by at least one time in a stopped condition, and a second heat generating amount control step for bringing a heat generating amount of said heater per unit time when the energization to said heater is turned ON to a second heat generating amount greater than said first heat generating amount after the entire peripheral surface of said rotatable fixing member is contacted with said sheet by at least one time in the stopped condition.

69. A storage medium according to claim 41, wherein said sheet is a paper.

* * * * *

UNITED STATES PATENT AND TRADEMARK OFFICE

CERTIFICATE OF CORRECTION

PATENT NO. : 6,094,559
DATED : July 25, 2000
INVENTOR(S) : Yasumasa Otsuka et al.

It is certified that error appears in the above-identified patent and that said Letters Patent is hereby corrected as shown below:

Column 1,
Line 37, “are”should read -- are/is --.
Line 39, “or/and” should read -- and/or --.

Column 2,
Line 61, “__in” should read -- in --.

Column 6,
Line 56, “be-described” should read -- be described --.

Column 7,
Line 12, “the-cleaning” should read -- the cleaning --.

Column 9,
Line 8, “illustrated,” should read -- illustration, --.

Column 10,
Line 3, “is” should read -- are --.

Column 12,
Line 54, “once” should read -- first --.
Line 66, “is” should read -- are --.

Column 13,
Line 13, “by cooling the toner once,” should read -- by first cooling the toner, --.
Line 15, “caused” should read -- be caused --.
Line 34, “not” should read -- not be --.
Line 45, “be” should be deleted.

Column 15,
Line 64, “is” should read -- are --.
Line 65, “once” should read -- first --.

Column 16,
Line 8, “adhered matters on” should read -- matter adhering to --.

Column 17,
Line 15, “fears” should read -- is feared --.

UNITED STATES PATENT AND TRADEMARK OFFICE

CERTIFICATE OF CORRECTION

PATENT NO. : 6,094,559
DATED : July 25, 2000
INVENTOR(S) : Yasumasa Otsuka et al.

It is certified that error appears in the above-identified patent and that said Letters Patent is hereby corrected as shown below:

Column 20,
Line 15, "(Sill)," should read -- (S111), --.
Line 36, "layer" should read -- later --.
Line 61, "lever" should read -- level --.
Line 62, "lever." should read -- level. --.

Column 22,
Line 36, "fears" should read -- is feared --.
Line 57, "eight" should read -- eighth --.

Column 23,
Line 9, "strip" should read -- strip S --.
Line 10, "P" should read -- $P_1$ --; and "P2" should read -- $P_2$ --.
Line 26, "eight" should read -- eighth --.

Signed and Sealed this

Thirtieth Day of March, 2004

JON W. DUDAS
*Acting Director of the United States Patent and Trademark Office*